US008852840B2

(12) United States Patent
Sakamoto et al.

(10) Patent No.: US 8,852,840 B2
(45) Date of Patent: Oct. 7, 2014

(54) MAGNETIC COMPOSITE PARTICLES, MAGNETIC CARRIER AND DEVELOPER

(75) Inventors: Muneyoshi Sakamoto, Hiroshima-ken (JP); Eiichi Kurita, Hiroshima-ken (JP); Hiromitsu Misawa, Hiroshima-ken (JP)

(73) Assignee: Toda Kogyo Corporation, Otake-shi, Hiroshima-ken (JP)

( * ) Notice: Subject to any disclaimer, the term of this patent is extended or adjusted under 35 U.S.C. 154(b) by 0 days.

(21) Appl. No.: 13/262,011

(22) PCT Filed: Mar. 24, 2010

(86) PCT No.: PCT/JP2010/055096

§ 371 (c)(1), (2), (4) Date: Nov. 21, 2011

(87) PCT Pub. No.: WO2010/113724

PCT Pub. Date: Oct. 7, 2010

(65) Prior Publication Data

US 2012/0064448 A1 Mar. 15, 2012

(30) Foreign Application Priority Data

| | | |
|---|---|---|
| Mar. 31, 2009 | (JP) | 2009-088030 |
| Oct. 28, 2009 | (JP) | 2009-248130 |
| Oct. 28, 2009 | (JP) | 2009-248131 |

(51) Int. Cl.

| | |
|---|---|
| ***G03G 9/00*** | (2006.01) |
| ***G03G 9/113*** | (2006.01) |
| ***G03G 9/083*** | (2006.01) |
| ***G03G 9/107*** | (2006.01) |
| ***H01F 1/26*** | (2006.01) |
| ***H01F 1/37*** | (2006.01) |
| *H01F 1/34* | (2006.01) |
| *H01F 1/14* | (2006.01) |

(52) U.S. Cl.

CPC ..... *H01F 1/26* (2013.01); *G03G 9/1138* (2013.01); *H01F 1/344* (2013.01); *G03G 9/0833* (2013.01); *C22C 2202/02* (2013.01); *G03G 9/0831* (2013.01); *G03G 9/1132* (2013.01); *G03G 9/1075* (2013.01); *G03G 9/113* (2013.01); *G03G 9/1135* (2013.01); *H01F 1/37* (2013.01); *G03G 9/0832* (2013.01); *B22F 2999/00* (2013.01); *G03G 9/107* (2013.01); *H01F 1/14* (2013.01)

USPC ..... 430/111.35; 430/111.3

(58) Field of Classification Search

USPC ..... 430/108.6, 111.1, 111.3, 111.35; 428/403

See application file for complete search history.

(56) References Cited

U.S. PATENT DOCUMENTS

| | | | | |
|---|---|---|---|---|
| 2005/0287484 | A1* | 12/2005 | Yano et al. | 430/434 |
| 2007/0116955 | A1* | 5/2007 | Chen et al. | 428/403 |
| 2007/0201917 | A1 | 8/2007 | Teshigawara | |

FOREIGN PATENT DOCUMENTS

| | | |
|---|---|---|
| JP | 07-098520 | 4/1995 |
| JP | 7-98520 | 4/1995 |
| JP | 7-295300 | 11/1995 |
| JP | 07-295300 | 11/1995 |
| JP | 2000-39741 | 2/2000 |
| JP | 2000-039741 | 2/2000 |
| JP | 2003-128791 | 5/2003 |
| JP | 2007-226054 | 9/2007 |
| JP | 2008-266228 | 11/2008 |

OTHER PUBLICATIONS

International Search Report for PCT/JP2010/55096 mailed Apr. 27, 2010.

English version of the International Preliminary Report on Patentability in PCT/JP2010/055096 mailed Nov. 24, 2011.

* cited by examiner

*Primary Examiner* — Stewart Fraser

(74) *Attorney, Agent, or Firm* — Nixon & Vanderhye P.C.

(57) ABSTRACT

The present invention relates to magnetic composite particles comprising at least magnetic fine particles and a bio-based polymer, wherein the magnetic composite particles have an average particle diameter of 10 to 100 μm, and a content of the magnetic fine particles in the magnetic composite particles is 50 to 99.9% by weight; a magnetic carrier; and a developer. The magnetic composite particles, magnetic carrier and developer according to the present invention are effective for reduction of environmental burden such as saving of underground sources and prevention of global warming, have a high safety for human bodies and a high durability, and are capable of forming developed images with a high quality.

12 Claims, No Drawings

MAGNETIC COMPOSITE PARTICLES, MAGNETIC CARRIER AND DEVELOPER

This application is the U.S. national phase of International Application No. PCT/JP2010/55096 filed 24 Mar. 2010 which designated the U.S. and claims priority to JP 2009-088030 filed 31 Mar. 2009, JP 2009-248130 filed 28 Oct. 2009, and JP 2009-248131 filed 28 Oct. 2009, the entire contents of each of which are hereby incorporated by reference.

TECHNICAL FIELD

The present invention relates to magnetic composite particles, a magnetic carrier and a developer, and more particularly, to magnetic composite particles which have a less environmental burden and a high durability and are capable of forming developed toner images with a high quality, and a magnetic carrier and a developer for electrophotographic development.

BACKGROUND ART

Electrophotography is a system in which a latent image formed on a photoconductive solid member using its photoconductivity is developed by allowing a toner in the form of colored particles to electrostatically adhere thereto, and the thus developed toner image is transferred and then fixed on a paper, etc. The electrophotographic system has been extensively used in the applications such as copying machines and printers, and further recently applied to general printing machines.

In the electrophotographic development, when using a toner having no magnetism, carrier particles called a magnetic carrier have been used together with the toner. The magnetic carrier serves not only for imparting an adequate amount of a positive or negative electrical charge to the toner owing to frictional electrification therebetween, but also for delivering the toner through a developing sleeve accommodating a magnet to near the surface of a photosensitive member on which a latent image is formed, by utilizing a magnetic force of the developing sleeve (A mixture of the magnetic carrier and the toner, etc., is a developer which is ready for immediate development of the latent image). In recent years, in the field of electrophotography, coloration of toner images developed tends to rapidly proceed. However, a color toner used for the above purpose has no magnetism, and there is therefore a rapidly increasing demand for the magnetic carrier. At the same time, there is a demand for a high quality of the resulting color images and a high copying speed thereof. To meet the requirements, the magnetic carrier is also required to have further improved functions.

Hitherto, as a material of a central portion of the magnetic carrier (hereinafter occasionally referred to as a "carrier core") or a material of the magnetic carrier itself, there have been developed iron powder carriers, ferrite carriers or binder-type carriers, and these carriers have been put into practice.

The iron powder carriers are in the form of a carrier core prepared by pulverizing an iron powder, and have a flake shape, a sponge shape or an amorphous shape in many cases. The iron powder carriers thus prepared from an iron powder is inexpensive, but have a large true specific gravity ranging from 7 to 8 and a large bulk density ranging from 3 to 4 g/cm$^3$. Therefore, a large driving force is required to stir the iron powder carriers in a developing device so that the iron powder carrier tends to frequently suffer from severe mechanical abrasion. For this reason, there tend to occur spent toners and deterioration in charge properties of the carrier itself, which tends to result in poor functions of the carrier for a short period of time or risk of damage to a photosensitive member used therewith.

The ferrite carriers are in the form of a magnetic carrier prepared by pulverizing ferrite having a smaller specific gravity than that of the iron powder, and frequently have a spherical shape as compared to the iron powder carriers. The ferrite carriers have a smaller true specific gravity of 4.5 to 5.5 and a smaller bulk density of 2 to 3 g/cm$^3$ than those of the iron powder carriers owing to the ferrite material, and therefore are enhanced in durability and cause a less damage to the photosensitive member as compared to the iron powder carriers. However, in the ferrite carriers, there tend to be used metals such as copper-zinc, manganese-magnesium-strontium, lithium-magnesium-calcium, etc., which are not safe for environments and human bodies. Further, since the ferrite carriers are prepared through the pulverization step, it may be difficult to finely control a shape thereof and reduce a particle diameter thereof. Thus, the ferrite carriers are not sufficiently suitable for high-image quality development in future.

The binder-type carriers are in the form of a magnetic carrier prepared by molding magnetic fine particles with a binder such as resins, and have a good durability and cause a less damage to the photosensitive member owing to a small bulk density of about 2.5 g/cm$^3$. The binder-type carriers are further classified into pulverized carriers and granulated carriers. The pulverized carriers tend to be hardly finely controlled in their shape, and the particle diameter tends to be hardly reduced. Therefore, the pulverized carriers are not sufficiently suitable for high-image quality development in future. The granulated carriers are likely to be adjustably controlled in their shape and formed into a spherical shape, a rice-grain shape, etc., and therefore tend to be readily controlled in fluidity or degree of contact with the toner. Further, the granulated carriers have a narrow particle size distribution, so that the particle diameter thereof tends to be readily reduced. For this reason, the granulated carriers are capable of realizing an enhanced durability and a high image quality. From these viewpoints, it is considered that the granulated binder-type carriers are extensively used in future.

The carrier cores have been coated with a resin, etc., in order to impart a good frictional electrification performance (electrical charge amount) and a good electrical resistivity thereto, and the thus coated carrier cores are used as a magnetic carrier. As the resin used for coating the carrier cores therewith or the binder resin used for the binder-type carriers, there have been employed thermoplastic resins such as vinyl-based resins and polyester-based resins, and thermosetting resins such as phenol-based resins, melamine-based resins and epoxy-based resins. Almost all of these resins are resins derived from underground sources such as petroleum and coal. However, environmental burden caused by using these underground sources has not been taken into consideration.

In recent years, the environmental problems such as exhaustion of underground sources and global warming have been noticed worldwide. For this reason, in order to realize medium- or long-term prosperity of human beings, it is required that the use of underground sources is reduced to a level as small as possible to suppress generation of carbon dioxide causing the global warming. In consequence, it is largely expected that various products are obtained from bio-based polymers which can be produced from vegetable raw materials, etc., and are therefore regenerative and reusable, and further generate a less amount of carbon dioxide. At present, in the market of carriers for electrophotography, the magnetic carriers have been used in an amount of about 9,700 tons (quoted from the "Results of Business of Japanese Makers, 2007", Nippon Data Supply Co., Ltd.), and it is considered that the magnetic carrier market becomes more and more expanded with the progress of coloration in future. If a part of several thousand tons of resin components used in the magnetic carriers are replaced with the bio-based polymers, it is considered to be effective for reduction in environmental burden such as saving of underground sources and prevention of global warming.

In addition, it is known that the bio-based polymers have a low toxicity to human bodies and is therefore safe. Thus, from the viewpoint of enhanced safety, the use of the bio-based polymers is desirable.

Also, some of the bio-based polymers have a biodegradability (of course, there are present those bio-based polymers having no biodegradability). Since the biodegradability tends to cause deterioration in durability and strength, the use of the bio-based polymers is not necessarily recommended in the above applications. However, there are known the techniques in which the bio-based polymers having a biodegradability are used as a part of the resin components in favor of their biodegradability (Patent Documents 1 and 2).

Patent Document 1: Japanese Patent Application Laid-Open (KOKAI) No. 7-98520

Patent Document 2: Japanese Patent Application Laid-Open (KOKAI) No. 7-295300

DISCLOSURE OF THE INVENTION

Problems to be Solved by the Invention

In Patent Document 1, there is described a magnetic carrier comprising a biodegradable substance in a binder resin of a binder-type carrier. More strictly, the biodegradable substances are classified into bio-based polymers and non-bio-based polymers. Polyphosphazene, polycyanoacrylate, etc., as described in Patent Document 1 are belonging to the non-bio-based polymers. Further, the bio-based polymers include biodegradable polymers and non-biodegradable polymers. Poly(trimethylene terephthalate), poly-α-methylene-γ-butyrolactone, etc., are classified into the bio-based polymers, but have no biodegradability. That is, the biodegradable substance and the bio-based polymer are quite different in technical concept from each other. The binder resin described in Patent Document 1 comprises non-biodegradable resins derived from underground sources such as a styrene-n-butyl methacrylate copolymer in an amount of 80%, and therefore no environmental burden of the binder resin is taken into consideration. Further, the glass transition point of the binder resin is as low as 0° C. and therefore already softened in room temperature condition, so that the magnetic carrier comprising such a binder resin tends to be deteriorated in durability. Furthermore, since the magnetic carrier described in Patent Document 1 is prepared through kneading and pulverizing steps, it may be difficult to suitably control a particle shape thereof and reduce a particle diameter thereof, and the magnetic carrier therefore tends to be unsuitable for high-image quality development. In addition, in Patent Document 1, any of chitin and chitosan/alginic acid proposed by the present invention are not taken into consideration.

Also, in Patent Document 2, there is described a magnetic carrier comprising a biodegradable resin in a binder resin of the binder-type carrier. As describe above, the biodegradable resin and the bio-based polymer are quite different in technical concept from each other. In addition, a 3-hydroxybutyrate-3-hydroxyvalerate copolymer (glass transition point: −1° C.), an alloy of starch and modified polyvinyl alcohol (glass transition point: 20° C.), poly(butylene succinate) (glass transition point: −40° C.), and polycaprolactone (glass transition point: −60° C.) as described in Patent Document 2 have a low glass transition point and therefore are already softened under room temperature condition, so that these resins tend to be deteriorated in fluidity, and the magnetic carrier produced therefrom tends to be deteriorated in durability. Further, since the magnetic carrier described in Patent Document 2 is prepared through kneading and pulverizing steps, it may be difficult to suitably control a particle shape and a particle diameter thereof, and reduce the particle diameter as described above. Therefore, the magnetic carrier described in Patent Document 2 is also unsuitable for high-image quality development. In addition, in Patent Document 2, any of chitin and chitosan/alginic acid proposed by the present invention are not taken into consideration.

A technical object of the present invention is to provide magnetic composite particles which are effective for reduction of environmental burden such as saving of underground sources and prevention of global warming, have a high safety for human bodies, a high durability, and are capable of forming developed images with a high quality; a magnetic carrier for electrophotographic developers; and a developer.

Means for Solving the Problems

The above technical object of the present invention can be achieved by the following aspects of the present invention.

That is, according to the present invention, there are provided Magnetic composite particles having an average particle diameter of 10 to 100 μm and comprising at least:

magnetic fine particles which contained in the magnetic composite particles in an amount of 50 to 99.9% by weight, and a bio-based polymer. (Invention 1).

Also, according to the prevent invention, there are provided the magnetic composite particles as described in the above Invention 1, wherein the content of the magnetic fine particles in the magnetic composite particles is 50 to 99% by weight, and the bio-based polymer is used as a binder for the magnetic fine particles (Invention 2).

Also, according to the prevent invention, there are provided the magnetic composite particles as described in the above Invention 1, wherein the content of the magnetic fine particles in the magnetic composite particles is 97 to 99.9% by weight, and the bio-based polymer is used for coating the magnetic fine particles therewith (Invention 3).

Also, according to the prevent invention, there are provided the magnetic composite particles as described in the above Invention 3, further comprising a binder other than the bio-based polymer, wherein the magnetic fine particles cooperate with the binder other than the bio-based polymer to form a core, and the core is coated with the bio-based polymer (Invention 4).

Also, according to the prevent invention, there are provided the magnetic composite particles as described in any one of the above Inventions 1 to 4, wherein the bio-based polymer has a glass transition point of not lower than 35° C. (Invention 5).

Also, according to the prevent invention, there are provided the magnetic composite particles as described in any one of the above Inventions 1 to 5, wherein the bio-based polymer is selected from a polymer selected from the group consisting of polylactic acid, polyglycolic acid, poly(trimethylene terephthalate), ethyl cellulose and poly-α-methylene-γ-butyrolactone; a copolymer comprising a monomer unit derived from any of these polymers; a polymer mixture comprising at least one of these polymers; chitin; and a chitosan/alginic acid composite material (Invention 6).

Also, according to the prevent invention, there are provided the magnetic composite particles as described in the above Invention 6, wherein the bio-based polymer is selected from a polymer selected from the group consisting of polylactic acid, polyglycolic acid, poly(trimethylene terephthalate), ethyl cellulose and poly-α-methylene-γ-butyrolactone; a copolymer comprising a monomer unit derived from any of these polymers; and a polymer mixture comprising at least one of these polymers (Invention 7).

Also, according to the prevent invention, there are provided the magnetic composite particles as described in the above Invention 6, wherein the bio-based polymer is selected from chitin; and a chitosan/alginic acid composite material (Invention 8).

Also, according to the prevent invention, there are provided the magnetic composite particles as described in any one of the above Inventions 1 to 8, wherein the bio-based polymer has a molecular weight of 2,000 to 1,000,000 (Invention 9).

Also, according to the prevent invention, there are provided the magnetic composite particles as described in any one of the above Inventions 1 to 9, wherein the magnetic composite particles comprise an alkali earth metal in an amount of not more than 1.0% by weight (Invention 10).

Also, according to the prevent invention, there are provided the magnetic composite particles as described in any one of the above Inventions 1 to 10, wherein the magnetic fine particles are ferrite or an iron powder (Invention 11).

Further, according to the prevent invention, there is provided a magnetic carrier comprising the magnetic composite particles as described in any one of the above Inventions 1 to 11 (Invention 12).

In addition, according to the prevent invention, there is provided a magnetic carrier comprising the magnetic composite particles as described in any one of the above Inventions 1 to 11 or the magnetic carrier as described in the above Invention 12, and a coating layer formed on a surface of the magnetic composite particles or the magnetic carrier (Invention 13).

Furthermore, according to the present invention, there is provided a developer comprising the magnetic composite particles as described in any one of the above Inventions 1 to 11 or the magnetic carrier as described in the above Invention 12 or 13 (Invention 14).

Effect of the Invention

The magnetic composite particles according to the present invention comprise a bio-based polymer and magnetic fine particles, are effective for reduction of environmental burden such as saving of underground sources and prevention of global warming, have a high safety for human bodies and a high durability, and are capable of forming developed images with a high quality. Therefore, the magnetic composite particles of the present invention are suitable for providing a magnetic carrier and a developer.

The magnetic carrier according to the present invention comprises the magnetic composite particles having the above-mentioned properties, is effective for reduction of environmental burden such as saving of underground sources and prevention of global warming, has a high safety for human bodies and a high durability, and is capable of forming developed images with a high quality. Therefore, the magnetic carrier of the present invention is suitable as a magnetic carrier and for providing a developer.

The developer according to the present invention comprises the magnetic composite particles having the above-mentioned properties, is effective for reduction of environmental burden such as saving of underground sources and prevention of global warming, has a high safety for human bodies and a high durability, and is capable of forming developed images with a high quality. Therefore, the developer of the present invention is suitable as a developer.

PREFERRED EMBODIMENTS FOR CARRYING OUT THE INVENTION

The construction of the present invention is described in detail below.

First, the magnetic composite particles according to the present invention are described.

The magnetic composite particles according to the present invention comprise at least magnetic fine particles and a bio-based polymer, and are characterized in that the magnetic composite particles have an average particle diameter of 10 to 100 μm, and a content of the magnetic fine particles in the magnetic composite particles is 50 to 99.9% by weight. As described in the above Inventions 2 to 4, the preferred embodiments of the magnetic composite particles according to the present invention include the embodiment in which the content of the magnetic fine particles in the magnetic composite particles is 50 to 99% by weight, and the bio-based polymer is used as a binder for the magnetic fine particles (Invention 2); the embodiment in which the content of the magnetic fine particles in the magnetic composite particles is 97 to 99.9% by weight, and the bio-based polymer is used for coating the magnetic fine particles therewith (Invention 3); and the embodiment in which the magnetic composite particles as described in the Invention 3 further comprise a binder other than the bio-based polymer, and the magnetic fine particles cooperate with the binder other than the bio-based polymer to form a core, and the core is coated with the bio-based polymer (Invention 4).

First, the magnetic composite particles according to Invention 2 are explained. The magnetic composite particles according to Invention 2 are magnetic composite particles in the form of aggregated particles comprising at least magnetic fine particles and a bio-based polymer (i.e., the bio-based polymer serves as a binder for the magnetic fine particles). The magnetic composite particles have an average particle diameter of 10 to 100 μm. When the average particle diameter of the magnetic composite particles is less than 10 μm, the resulting particles may fail to exhibit a fluidity. When the average particle diameter of the magnetic composite particles is more than 100 μm, it is not possible to obtain a high-quality image. The average particle diameter of the magnetic composite particles is preferably 10 to 90 μm, more preferably 10 to 70 μm and especially preferably 12 to 70 μm. The magnetic composite particles may be any shape including a spherical shape, a granular shape, a plate shape or an acicular shape. Among these particle shapes, preferred are a spherical shape and a granular shape.

The content of the magnetic fine particles in the magnetic composite particles according to Invention 2 is 50 to 99% by weight. When the content of the magnetic fine particles is less than 50% by weight, the resulting magnetic composite particles may fail to exhibit sufficient magnetic properties. When the content of the magnetic fine particles is more than 99% by weight, the binder tends to be hardly functioned, so that the resulting composite particles may fail to maintain their shape.

The content of the magnetic fine particles in the magnetic composite particles is preferably 60 to 98% by weight, more preferably 65 to 97% by weight and especially preferably 65 to 95% by weight.

The glass transition point of the bio-based polymer used in the present invention is not lower than 35° C. When the glass transition point of the bio-based polymer is lower than 35° C., there tends to occur such a case in which the glass transition point of the bio-based polymer may be lower than room temperature, so that the magnetic composite particles tend to be softened even at the room temperature, thereby failing to exhibit a sufficient durability when used for a magnetic carrier or a developer. The glass transition point of the bio-based polymer is preferably not lower than 38° C. and more preferably not lower than 40° C.

The bio-based polymer used in the present invention is preferably a polymer selected from the group consisting of polylactic acid, polyglycolic acid, poly(trimethylene terephthalate), ethyl cellulose and poly-α-methylene-γ-butyrolactone, a copolymer comprising a monomer unit derived from any of these polymers, a polymer mixture comprising at least one of these polymers, chitin, or a chitosan/alginic acid composite material. There may be present an infinite number of copolymers comprising a monomer unit derived from any of these bio-based polymers. Examples of the copolymers include copolymers of bio-based polymers such as polylactic acid/polyglycolic acid copolymers, polylactic acid/poly-ε-caprolactone copolymers, polylactic acid/polyglycolic acid/poly-ε-caprolactone copolymers, polylactic acid/poly(dioxepanone) copolymers, polylactic acid/poly(ethylene oxalate) copolymers, polylactic acid/polymalic acid copolymers, polylactic acid/polymandelic acid copolymers, poly-D,L-lactic acid copolymers, poly-α-methylene-γ-butyrolactone-poly(methyl α-methylacetoxyacrylate) copolymers. As the above copolymers, there may also be used those copolymers comprising, as a part thereof, a monomer or polymer having a glass transition point lower than that described above, as long as the copolymers have a glass transition point of not lower than 40° C. as a whole. There may also be present an infinite number of the polymer mixtures. Examples of the polymer mixtures include a mixture of L-polylactic acid and D-polylactic acid (inclusive of stereo complexes thereof), a mixture of L-polylactic acid and poly-α-methylene-γ-butyrolactone, and the like. These compounds are prepared from bio-based materials, and therefore are effective for reduction of environmental burden such as saving of underground sources and prevention of global warming, and safe for human bodies.

The optical isomers of the bio-based polymer, if any, may be any of an L-isomer, a D-isomer, a racemic modification and a meso-isomer. Further, there may also be used a stereocomplex in the form of a composite of L- and D-isomers. In addition, the bio-based polymer may also comprise inorganic particles such as silica, titanium oxide, clay, talc, carbon black and alumina, or organic materials such as octamethylenedicarboxylic acid dibenzoyl hydrazine, melamine, N,N',N"-tricyclohexyl-1,3,5-benzenetricarboxamide, carbodiimide, glycerol monostearate, glycerol monopalmitate, glycerol monobehenate, glycerol monooleate and glycerol diacetomonolaurate.

The bio-based polymer has a molecular weight of 2,000 to 1,000,000. When the molecular weight of the bio-based polymer is less than 2,000, the bio-based polymer tends to hardly maintain a sufficient strength as a binder. The bio-based polymer having a molecular weight of more than 1,000,000 tends to be hardly molded and therefore may fail to form the composite particles as aimed. The molecular weight of the bio-based polymer is preferably 4,000 to 800,000 and more preferably 4,500 to 500,000.

The content of the bio-based polymer in the magnetic composite particles is 1 to 50% by weight. When the content of the bio-based polymer is less than 1% by weight, the bio-based polymer may fail to act as a binder and therefore form the composite particles as aimed. When the content of the bio-based polymer is more than 50% by weight, the resulting composite particles may fail to exhibit sufficient magnetic properties. The content of the bio-based polymer in the magnetic composite particles is preferably 2 to 40% by weight, more preferably 3 to 35% by weight and especially preferably 5 to 35% by weight.

The bio-based polymer preferably comprises an alkali earth metal. Examples of the alkali earth metal include beryllium, magnesium, calcium, strontium, barium and radium. The bio-based polymer comprising these alkali earth metals is capable of forming a composite body with an ionomer, etc., thereby producing more strongly bonded composite particles. Among these alkali earth metals, preferred are magnesium, calcium, strontium and barium, more preferred are magnesium and calcium, and still more preferred is calcium. As a counter ion of the alkali earth metal, there may be used a hydrochloride ion, a sulfate ion, a phosphate ion, a borate ion, an acetate ion, an oxalate ion and a citrate ion. Among these counter ions, preferred are a hydrochloride ion and an acetate ion.

The content of the alkali earth metal in the magnetic composite particles is preferably not more than 1.0% by weight and more preferably not more than 0.8% by weight.

As the magnetic fine particles, there may be used iron oxide fine particles such as magnetite and maghemite, spinel ferrite fine particles comprising one or more elements selected from Mn, Co, Ni, Zn, Cu, etc., hexagonal ferrite fine particles comprising Ba, Sr, Pb, etc., garnet ferrite fine particles comprising rare earth elements, and fine particles of iron or iron alloys having an oxide film on the surface thereof. Among these magnetic fine particles, preferred are iron oxide fine particles such as magnetite. The magnetic fine particles have an average particle diameter of 20 nm to 10 μm. In view of a good strength of the resulting magnetic composite particle, the average particle diameter of the magnetic fine particles is preferably 50 to 500 nm, more preferably 50 to 400 nm and especially preferably 50 to 300 nm. The shape of the magnetic fine particles may be any shape including a spherical shape, a granular shape and an acicular shape.

The magnetic fine particles may also comprise non-magnetic fine particles in order to control magnetic properties and specific gravity of the resulting magnetic composite particles. The non-magnetic fine particles are formed of a compound which is in the form of an oxide, a hydroxide, a carbonate or a sulfate of at least one element selected from the group consisting of Mg, Ca, Ba, Ti, Zr, Ta, V, Nb, Cr, Mo, W, Mn, Co, Ni, Cu, Ag, Au, Zn, Al, Ga, Si and Ge. Examples of the non-magnetic fine particles include iron oxide fine particles such as hematite, goethite and ilmenite; silicon oxide fine particles such as silica; talc fine particles; titanium oxide fine particles such as rutile and anatase; aluminum compound fine particles such as alumina and boehmite; calcium carbonate fine particles; magnesium compound fine particles such as magnesia and hydrotalcite; zinc oxide fine particles; barium sulfate fine particles; and carbon-based fine particles such as carbon black and lamp black. Among these non-magnetic fine particles, preferred are carbon-based fine particles, silicon oxide fine particles, titanium oxide fine particles and aluminum compound fine particles. The non-magnetic fine particles preferably have an average particle diameter of 20 nm to 10 μm. In view of a good strength of the resulting magnetic composite particles, the average particle diameter of the non-magnetic fine particles is more preferably 50 to 500 nm and still more preferably 50 to 300 nm. The shape of the non-magnetic fine particles may be any shape including a spherical shape, a granular shape and an acicular shape.

The surface of the respective magnetic fine particles is preferably subjected to hydrophobic surface treatment. The hydrophobic surface treatment may be conducted for the purposes of enhancing adhesion between the magnetic fine particles and the bio-based polymer and producing the strongly bonded magnetic composite particles, and further for the purpose of allowing the resulting magnetic composite particles to exhibit a good environmental stability such as a good moisture resistance.

The hydrophobic surface treatment may be carried out using a silane-based surface-treating agent, a titanium-based surface-treating agent, an organic compound capable of being bonded onto the surface of the magnetic fine particles through an organic reaction, or a substance capable of the hydrophobic surface treatment such as a surfactant or a hydrophobic resin. These surface treating agents may be used alone or in the form of a mixture of any two or more thereof.

Examples of the silane-based surface-treating agent include methyl trimethoxysilane, methyl triethoxysilane, dimethyl diethoxysilane, dimethyl diethoxysilane, trimethyl trimethoxysilane, triethyl ethoxysilane, hexyl trimethoxysilane, hexyl triethoxysilane, decyl trimethoxysilane, phenyl trimethoxysilane, phenyl triethoxysilane, diphenyl dimethoxysilane, diphenyl diethoxysilane, triphenyl ethoxysilane, vinyl trimethoxysilane, vinyl triethoxysilane, methacryloxypropyl triethoxysilane, trifluoropropyl trimethoxysilane, methyl trichlorosilane, dimethyl dichlorosilane, trimethyl chlorosilane, hexamethyl disilazane, hexaphenyl disilazane, trimethyl silane, allyl dimethyl chlorosilane, allyl phenyl dichlorosilane, benzyl dimethyl chlorosilane, bromomethyldimethyl chlorosilane, α-chloroethyl trichlorosilane, β-chloroethyl trichlorosilane, chloromethyldimethyl chlorosilane, triorganosilane mercaptan, trimethylsilyl mercaptan, triorganosilyl acrylate, vinyldimethyl acetoxysilane, hexamethyl disiloxane, 1,3-divinyltetramethyl disiloxane and 1,3-diphenyltetramethyl disiloxane.

Examples of the titanium-based surface-treating agent include isopropoxytitanium triisostearate, isopropoxytitanium dimethacrylate isostearate, isopropoxytitanium tridodecylbenzene sulfonate, isopropoxytitanium trisdioctyl phosphate, isopropoxytitanium tri-N-ethylaminoethyl aminate, titanium bisdioctyl pyrophosphate oxyacetate, bisdioctyl phosphate ethylenedioctyl phosphate and di-n-butoxy bis(triethanol aminato)titanium.

Examples of the organic compound capable of being bonded onto the surface of the magnetic fine particles through an organic reaction include aliphatic acids such as caproic acid, caprylic acid, capric acid, lauric acid, myristic acid, palmitic acid, stearic acid, oleic acid, behenic acid, beef tallow fatty acid, castor oil-hardened fatty acid, soybean fatty acid, palmitoleic acid, oleic acid, linoleic acid, α-linolenic acid and γ-linolenic acid, and salts, esters and acid chlorides of these acids; higher alcohols such as lauryl alcohol, myristyl alcohol, cetyl alcohol, octyl alcohol, decyl alcohol, sedostearyl alcohol, stearyl alcohol, 2-octyl dodecanol and behenyl alcohol; hydrophobic amino acids such as glycine, alanine, phenyl alanine, leucine, isoleucine and valine, and peptides and proteins comprising a large amount of these hydrophobic amino acids; thiols such as thiophenol, butane thiol, pentane thiol, hexane thiol, heptane thiol, octane thiol, decyl thiol and dodecyl thiol; alkyl halides such as ethyl chloride, butyl chloride, pentyl chloride, hexyl chloride and benzyl chloride; acid chlorides such as benzoyl chloride and hexylcarboxychloride.

Examples of the surfactant include glycerol monostearate, glycerol monooleate, glycerol mono caprylate, propylene glycol monostearate, sorbitan monostearate, sorbitan distearate, sorbitan tristearate, sorbitan monooleate, sorbitan dioleate, sorbitan trioleate, sorbitan sesqui-oleate, sorbitan coconut oil fatty acid ester, sorbitan monopalmitate, isostearyl glyceryl ether, lauryl trimethyl ammonium chloride, cetyl trimethyl ammonium chloride and stearyl trimethyl ammonium chloride. Examples of the hydrophobic resin include the above bio-based polymers; homopolymers of styrene and substituted styrenes such as polystyrene and polyvinyl toluene; styrene-based copolymers such as styrene/propylene copolymers, styrene/vinyl toluene copolymers, styrene/vinyl naphthalene copolymers, styrene/methyl acrylate copolymers, styrene/ethyl acrylate copolymers, styrene/butyl acrylate copolymers, styrene/octyl acrylate copolymers, styrene/dimethylaminoethyl acrylate copolymers, styrene/methyl methacrylate copolymers, styrene/ethyl methacrylate copolymers, styrene/butyl methacrylate copolymers, styrene/dimethylaminoethyl methacrylate copolymers, styrene/vinyl methyl ether copolymers, styrene/vinyl ethyl ether copolymers, styrene/vinyl methyl ketone copolymers, styrene/butadiene copolymers, styrene/isoprene copolymers, styrene/maleic acid copolymers and styrene/maleic acid ester copolymers; poly(methyl methacrylate); poly(butyl methacrylate); polyvinyl acetate; polyethylene; polypropylene; polyvinyl butyral; silicone resins; polyester resins; polyamide resins; epoxy resins; polyacrylic acid resins; rosins; modified rosins; terpene resins; phenol resins; aliphatic or alicyclic hydrocarbon resins; aromatic petroleum resins; paraffin waxes; and carnauba waxes.

The hydrophobic surface-treating agent is preferably treated in an amount of 0.1 to 20% by weight and more preferably 0.1 to 10% by weight based on the weight of the magnetic fine particles.

The magnetic composite particles according to Invention 2 preferably have a bulk density of not more than 2.5 g/cm$^3$ and more preferably 1.5 to 2.5 g/cm$^3$.

The magnetic composite particles according to Invention 2 preferably have a specific gravity of 2.5 to 5.2 and more preferably 2.5 to 4.5.

The magnetic composite particles according to Invention 2 preferably have a BET specific surface area of 0.1 to 1.0 m$^2$/g and more preferably 0.1 to 0.9 m$^2$/g.

The magnetic composite particles according to Invention 2 preferably have a fluidity of not less than 20 sec/50 g.

The magnetic composite particles according to Invention 2 preferably have an electrical resistivity of $1\times10^7$ to $1\times10^{15}$·cm, more preferably $1.0\times10^7$ to $1\times10^{12}$·cm and especially preferably $5.0\times10^7$ to $1\times10^{12}$·cm.

The magnetic composite particles according to Invention 2 preferably have a saturation magnetization of 20 to 80 Am$^2$/kg (20 to 80 emu/g) and more preferably 40 to 80 Am$^2$/kg (40 to 80 emu/g).

Next, the preferred embodiment according to Invention 3 in which the content of the magnetic fine particles in the magnetic composite particles is 97 to 99.9% by weight, and the respective magnetic fine particles are coated with the bio-based polymer, is explained. In addition, another preferred embodiment of Invention 3 in which the magnetic composite particles further comprise a binder other than the bio-based polymer, and the core comprising the magnetic fine particles and the binder other than the bio-based polymer is coated with the bio-based polymer (i.e., Invention 4) is also explained below.

The magnetic composite particles according to Inventions 3 and 4 are also in the form of a magnetic carrier comprising at least a carrier core coated with the bio-based polymer. In the following, these magnetic composite particles are explained with respect to such a magnetic carrier.

The magnetic carrier according to Inventions 3 and 4 has an average particle diameter of 10 to 100 μm. When the average particle diameter of the magnetic carrier is less than 10 μm, the resulting carrier may fail to exhibit a good fluidity. When the average particle diameter of the magnetic carrier is more than 100 μm, it is not possible to attain a high image quality. The average particle diameter of the magnetic carrier is preferably 15 to 90 μm and more preferably 20 to 70 μm. The magnetic carrier may be of any particle shape including a spherical shape, a granular shape, a plate shape and an acicular shape. Among these particles shapes, preferred are a spherical shape and a granular shape.

As the bio-based polymer, there may be used the same polymers as described in the above Invention 2.

The coating amount of the bio-based polymer on the magnetic carrier according to Inventions 3 and 4 is 0.1 to 3.0% by weight. When the coating amount of the bio-based polymer is less than 0.1% by weight, the properties of the bio-based polymer tends to be hardly exhibited. When the coating amount of the bio-based polymer is more than 3.0% by weight, the carrier particles tend to be adhered to each other, so that it is not possible to exhibit the properties of the magnetic carrier. The coating amount of the bio-based polymer on the magnetic carrier is preferably 0.2 to 2.5% by weight, more preferably 0.3 to 2.2% by weight and still more preferably 0.5 to 2.0% by weight.

The magnetic carrier according to Inventions 3 and 4 preferably has a bulk density of not more than 3.0 g/cm$^3$ and more preferably 1.5 to 2.8 g/cm$^3$.

The magnetic carrier according to Inventions 3 and 4 preferably has a specific gravity of 2.5 to 5.2 and more preferably 2.5 to 4.8.

The magnetic carrier according to Inventions 3 and 4 preferably has a BET specific surface area of 0.05 to 1.5 m$^2$/g and more preferably 0.05 to 1.2 m$^2$/g.

The magnetic carrier according to Inventions 3 and 4 preferably has a fluidity of not less than 20 sec/50 g.

The magnetic carrier according to Inventions 3 and 4 preferably has an electrical resistivity of $1\times10^9$ to $1\times10^{16}$·cm and more preferably $1.0\times10^7$ to $1\times10^{16}$·cm.

The magnetic carrier according to Inventions 3 and 4 preferably has a saturation magnetization of 20 to 80 Am$^2$/kg (20 to 80 emu/g) and 40 to 80 Am$^2$/kg (40 to 80 emu/g).

As the carrier core used in Inventions 3 and 4, there may be used binder-type carriers, ferrite carriers and iron powder carriers. Among these carrier cores, preferred are binder-type carriers and ferrite carriers.

The ferrite carriers and the iron powder carriers are basically the same as those magnetic fine particles described in the above Invention 2, i.e., iron oxide fine particles such as magnetite and maghemite; spinel ferrite fine particles comprising at least one element selected from the group consisting of Mn, Co, Ni, Zn, Cu, etc., such as magnetite and maghemite; hexagonal ferrite fine particles comprising Ba, Sr, Pb, etc., garnet ferrite fine particles comprising rare earth elements, or fine particles of iron or iron alloys having an oxide film on the surface thereof. These fine particles may be added with the non-magnetic particles or may be subjected to hydrophobic surface treatments in the same manner as described in the above Invention 2.

The binder-type carrier comprises the magnetic composite particles and a binder. As the binder, there may be used bio-based polymers and/or binders other than the bio-based polymers. As the bio-based polymers, there may be used the same bio-based polymers as those explained in the above Invention 2.

The embodiment using the binders other than the bio-based polymers corresponds to the magnetic composite particles (also referred to as the magnetic carrier) described in Invention 4. As the binders other than the bio-based polymers, there may be used acrylic resins, styrene-acrylic resins, silicone resins, polyester resins, polyurethane resins, and mixtures or copolymers of any two or more of these resins.

The average particle diameter of the carrier core used in Inventions 3 and 4 is preferably 10 to 100 μm. When the average particle diameter of the carrier core is less than 10 μm, the resulting magnetic carrier may fail to exhibit a good fluidity. When the average particle diameter of the carrier core is more than 100 μm, it is not possible to attain a high image quality. The average particle diameter of the carrier core is more preferably not more than 90 μm and more preferably 10 to 70 μm. The carrier core may be of any particle shape including a spherical shape, a granular shape, a plate shape and an acicular shape. Among these particle shapes, preferred are a spherical shape and a granular shape.

In the present invention, inorganic fine particles may be added to the bio-based polymer. The amount of the inorganic fine particles added to the bio-based polymer is less than 100% by weight based on the weight of the bio-based polymer. When the amount of the inorganic fine particles added is not less than 100% by weight, the bio-based polymer tends to be considerably deteriorated in durability. The amount of the inorganic fine particles added to the bio-based polymer is preferably less than 80% by weight and more preferably less than 50% by weight. As the inorganic fine particles, there are preferably used fine particles of compounds including an oxide, a hydroxide, a carbonate and a sulfate of at least one element selected from the group consisting of Mg, Ca, Ba, Ti, Zr, Ta, V, Nb, Cr, Mo, W, Mn, Fe, Co, Ni, Cu, Ag, Au, Zn, Al, Ga, Si and Ge. Examples of the inorganic fine particles include silicon oxide fine particles such as silica; titanium oxide fine particles such as rutile and anatase; aluminum compound fine particles such as alumina and boehmite; calcium carbonate fine particles; magnesium compound fine particles such as magnesia and hydrotalcite; zinc oxide fine particles; barium sulfate fine particles; iron oxide fine particles such as hematite, magnetite and goethite; and carbon-based fine particles such as lamp black and carbon black. Among these inorganic fine particles, preferred are silicon oxide fine particles, titanium oxide fine particles, aluminum compound fine particles and carbon-based fine particles.

Next, the process for producing the magnetic composite particles according to Invention 2 is described.

The magnetic composite particles according to the present invention can be produced through the respective steps including a surface treatment step, a dispersion step, a granulation step and a post-treatment step.

In the present invention, first, the hydrophobic surface-treating agent may be applied onto the surface of the magnetic fine particles by reacting or adsorbing the surface-treating agent thereto, if required, to obtain hydrophobilized magnetic fine particles (surface treatment step). The thus obtained hydrophobilized magnetic fine particles are mixed and dispersed in an organic solvent in which the bio-based polymer, etc., are dissolved or dispersed, to form a dispersion phase (dispersion step). The resulting dispersion phase is added and suspended in a continuous phase, or a suspension stabilizer-containing continuous phase to prepare a suspension comprising droplets having an aimed size. Then, heat or the like is applied to the suspension to dry and remove the organic solvent in the droplets without drying the continuous phase, thereby obtaining a slurry of granulated magnetic composite particles (granulation step). The resulting slurry was fully washed and then dried to obtain the magnetic composite particles (post-treatment step). In addition, the thus obtained magnetic composite particles may be subjected to classification, if required. Meanwhile, in the granulation step, the above dispersion phase may be sprayed in water, a buffer solution, water in which the bio-based polymer is dissolved, or a buffer solution in which the bio-based polymer is dissolved, to obtain a hydrogel of the magnetic composite particles (granulation step), and the thus obtained hydrogel is fully washed and dried to obtain the magnetic composite particles. The resulting magnetic composite particles may be further subjected to classification, if required (post-treatment step). Also, in the case of producing the magnetic composite particles comprising an alkali earth metal, the magnetic fine particles are dispersed in a bio-based polymer solution or an alkali earth metal salt-containing bio-based polymer solution (dispersion step), and the resulting dispersion is sprayed in water, a buffer solution, or water or a buffer solution in which the bio-based polymer and/or the alkali earth metal salt are dissolved, thereby obtaining a hydrogel of the magnetic composite particles (granulation step). The thus obtained hydrogel is fully washed and then dried to obtain the magnetic composite particles. Further, the thus obtained magnetic composite particles may be subjected to classification (post-treatment step).

In the above surface treatment step, the magnetic fine particles are reacted with the hydrophobic surface-treating agent, or the hydrophobic surface-treating agent is adsorbed onto the magnetic fine particles, to render the surface of the magnetic fine particles hydrophobic, thereby enhancing adhesion of the magnetic fine particles to the bio-based polymer.

The surface treatment may be carried out by either a dry method or a wet method. In the dry method, there may be used a wheel-type kneader, a blade-type kneader, a ball-type kneader, a roll-type kneader, etc. In the wet method, there may be used a ball mill, a sand mill, an attritor, a roll mill, a beads mill, a colloid mill, an ultrasonic homogenizer, a high-pressure homogenizer, etc.

In the dispersion step, the hydrophobic surface-treated magnetic fine particles are dispersed in an organic solvent in which the bio-based polymer, etc., are dissolved or dispersed, or an alkali earth metal salt aqueous solution to prepare a dispersion phase (dispersion of the magnetic fine particles).

The organic solvent is required to be a solvent in which the bio-based polymer, etc., can be dissolved or dispersed, but which is incapable of being dissolved in the continuous phase. Specific examples of the organic solvent include dichloromethane, chloroform, carbon tetrachloride, chloroethane, 1,2-dichloroethane, 1,1-dichloroethylene, trans-1,2-dichloroethylene, cis-1,2-dichloroethylene, trichloroethylene, tetrachloroethylene, 1,2-dichloroethyl ether, dibromomethane, bromoform, carbon tetrabromide, bromoethane, 1,2-dibromoethane, 1,1-dibromoethylene, 1,2-dibromoethyl ether, hexane, cyclohexane, benzene, toluene, xylene, chlorobenzene, methyl ethyl ketone, ethyl acetate, diethyl ether, dibutyl ether, tetrahydrofuran, 1,4-dioxane and supercritical carbon dioxide, etc. Also, when using chitin as the bio-based polymer, a strong-acid solvent is preferably used as the organic solvent. Specific examples of the strong-acid solvent include organic acids such as formic acid and acetic acid, and inorganic acid-dissolved organic solvents such as methanol-calcium chloride saturated solution. In addition, when using chitosan as the bio-based polymer, a weak acid aqueous solution is preferably used as the organic solvent. Specific examples of the weak acid aqueous solution for the chitosan include an acetic acid aqueous solution, a hydrochloric acid aqueous solution, a sulfuric acid aqueous solution, a phosphoric acid aqueous solution and a boric acid aqueous solution. The alginic acid as the bio-based polymer is preferably dissolved in pure water.

Examples of the apparatus used in the dispersion step include a ball mill, a sand mill, an attritor, a roll mill, a beads mill, a colloid mill, an ultrasonic homogenizer and a high-pressure homogenizer.

In the granulation step, the dispersion phase obtained in the dispersion step is added and suspended in a continuous phase or a suspension stabilizer-containing continuous phase to prepare a suspension comprising droplets having the aimed size, and then heat or the like is applied to the suspension to dry and remove the organic solvent in the droplets without drying the continuous phase, thereby obtaining the granulated magnetic composite particles.

Examples of the suspension stabilizer include colloidal silica, a silane coupling agent, a surfactant or the like.

The colloidal silica is such a dispersion as formed by dispersing silica in the form of colloids in water, and the silica may be dispersed in an acid, neutral or basic condition.

Examples of the silane coupling agent include vinyl trichlorosilane, vinyl trimethoxysilane, vinyl triethoxysilane, 2-(3,4-epoxycyclohexyl)ethyl trimethoxysilane, 3-glycidoxypropyl trimethoxysilane, 3-glycidoxypropyl diethoxysilane, styryl trimethoxysilane, 3-methacryloxypropylmethyl dimethoxysilane, 3-methacryloxypropyl trimethoxysilane, 3-methacryloxypropylmethyl diethoxysilane, 3-methacryloxypropyl triethoxysilane, 3-acryloxypropyl trimethoxysilane, N-2-(aminoethyl)-3-aminopropylmethyl dimethoxysilane, N-2-(aminoethyl)-3-aminopropyl trimethoxysilane, N-2-(aminoethyl)-3-aminopropyl triethoxysilane, 3-aminopropyl trimethoxysilane, 3-aminopropyl triethoxysilane, 3-triethoxysilyl-N-(1,3-dimethyl-butylidene)propyl amine, N-phenyl-3-aminopropyl trimethoxysilane, a sulfuric acid salt of N-(vinyl benzyl)-2-aminoethyl-3-aminopropyl trimethoxysilane, 3-ureido-propyl triethoxysilane, 3-chloropropyl trimethoxysilane, 3-mercapto-propylmethyl dimethoxysilane, 3-mercapto-propyl trimethoxysilane, bis ((triethoxysilylpropyl)tetrasulfide, 3-isocyanato-propyl triethoxysilane, tetramethoxysilane, tetraethoxysilane, methyl triethoxysilane, dimethyl diethoxysilane, phenyl triethoxysilane, hexamethyl disilazane, hexyl trimethoxysilane, decyl trimethoxysilane and fluoropropyl trimethoxysilane.

Examples of the surfactant include glycerol monostearate, glycerol monooleate, glycerol monocaprylate, propylene glycol monostearate, sorbitan monostearate, sorbitan distearate, sorbitan tristearate, sorbitan monooleate, sorbitan dioleate, sorbitan trioleate, sorbitan sesqui-oleate, sorbitan coconut oil fatty acid ester, sorbitan monopalmitate, isostearyl glyceryl ether, lauryl trimethyl ammonium chloride, cetyl trimethyl ammonium chloride and stearyl trimethyl ammonium chloride.

It is required that the continuous phase is a medium in which the dispersion phase is not dissolved but fully suspended. Specific examples of the continuous phase include water, methanol, ethanol, 2-propanol, butanol, ethylene glycol, glycerol and polyethylene glycol.

Examples of the apparatus used for the suspension include a homomixer, a homogenizer, a high-pressure homogenizer, an ultrasonic homogenizer, a stirrer, an internal circulation-type stirrer, an external circulation-type stirrer and a thin film rotating-type stirrer.

In the present invention, the concentration of the suspension as well as stirring conditions of the above apparatus used for the suspension may be suitably controlled to prepare the desired droplets.

In the present invention, the heat treatment may be conducted in a temperature range capable of vaporizing the above organic solvent.

In the other preferred embodiment of the granulation step, the dispersion of the magnetic fine particles is sprayed in water or in water in which the bio-based polymer is dissolved, or in a buffer solution, to thereby obtain a hydrogel of the magnetic composite particles.

The buffer solution may be used according to the requirements for the purposes of preventing large change of a hydrogen ion concentration (pH) in the reaction system between before and after the reaction and stabilizing a particle shape and a particle size of the resulting magnetic composite particles. As the kinds of the buffer solution, there may be used a citric acid buffer solution, an acetic acid buffer solution, a citric acid/phosphoric acid buffer solution, a Tris/hydrochloric acid buffer solution, etc.

Examples of the apparatus used for spraying the slurry of the magnetic fine particles include ordinary sprayers such as air brush, an ultrasonic sprayer, and a sprayer having a piezoelectric element which may be used in ink-jet printing, etc.

In the post-treatment step, in order to remove the suspension stabilizer added in the granulation step or impurities produced during the preparation step, the resulting magnetic composite particles are subjected to washing with water by adding, if required, sodium hydroxide, potassium hydroxide, acetic acid, hydrochloric acid, sulfuric acid, etc., to the water, to purify and separate the magnetic composite particles, followed by finally drying the resulting particles. Further, in order to attain the particles having the aimed particle size and particle size distribution, the obtained magnetic composite particles may be subjected to classification.

The water-washing and separation procedures may be carried out by a centrifugal separation method, or a filtration method such as suction filtration, pressure filtration, ultrafiltration, reverse osmosis membrane filtration, etc.

In the drying step, the magnetic composite particles may be dried by ordinary methods such as air-flow drying, vacuum drying, spray drying, freeze drying, etc., to obtain the dried particles.

The classification procedure may be carried out using a classifier such as an electromagnetic sieve, a turbo screener and a turbo classifier.

Next, the process for producing the magnetic composite particles according to Invention 3 or 4 (also referred to as a "magnetic carrier") is described.

The magnetic carrier according to Invention 3 or 4 can be produced by sequentially conducting the respective steps including a coating step and a curing step, followed by a post-treatment after completion of the curing step, if required.

In Invention 3 or 4, first, the carrier core is brought into contact with the bio-based polymer dissolved or dispersed in a solvent to coat the surface of the carrier core with the bio-based polymer (coating step). Next, the thus coated carrier core is heated to remove the solvent in the bio-based polymer to fix the bio-based polymer on the surface of the carrier core (curing step). If required, the thus cured product is subjected to classification as a post-treatment to thereby obtain a magnetic carrier (post-treatment step).

In the coating step, the carrier core is brought into contact with the bio-based polymer dissolved or dispersed in the solvent to coat the surface of the carrier core with the bio-based polymer.

The coating step may be carried out by either a dry method or a wet method. In the dry method, there may be used a mixing stirrer, a universal stirrer, a wheel-type kneader, a blade-type kneader, a ball-type kneader, a roll-type kneader, etc, as well as a rolling fluidized bed coating device. In the wet method, there may be used a ball mill, a sand mill, an attritor, a roll mill, a beads mill, a colloid mill, an ultrasonic homogenizer, a high-pressure homogenizer, etc.

The solvent used is preferably capable of dissolving or dispersing the bio-based polymer therein, and there may be used those solvents as described in the process for producing the magnetic composite particles according to the above Invention 2.

In order to enhance adhesion between the bio-based polymer and the carrier core or suitably control properties thereof such as charge amount and electrical resistivity, the carrier core may be subjected to pre-coating before the above coating step. The amount of the surface pre-treatment agent (pre-coating agent) applied to the carrier core is preferably 0.05 to 1.0% by weight.

Examples of the pre-coating agent include a coupling agent, inorganic fine particles and resins. These pre-coating agents may be used alone or in combination of any two or more thereof.

The coupling agent includes a silane-based coupling agent and a titanium-based coupling agent. As the silane-based coupling agent, there may be used those described in the process for producing the magnetic composite particles according to the above Invention 2. Examples of the titanium-based coupling agent include isopropoxy titanium triisostearate, isopropoxy titanium dimethacrylate isostearate, isopropoxy titanium tridecyl benzene sulfonate, isopropoxy titanium trisdioctyl phosphate, isopropoxy titanium tri(N-ethylaminoethyl)aminate, titanium bis(dioctyl pyrophosphate)oxyacetate, bis(dioctyl phosphate)ethylene-dioctyl phosphate, and di-n-butoxy-bis(triethanol aminato)titanium.

As the inorganic fine particles, there may be used those inorganic fine particles to be added to the bio-based polymer as described with respect to the magnetic composite particles according to the above Invention 2, 3 or 4.

Examples of the resins include the above-mentioned bio-based polymers, as well as acrylic resins, styrene-acrylic resins, silicone resins, polyester resins, urethane resins and copolymers of any two or more kinds of these resins. Specific examples of the resins include polymers of monomers selected from styrene-based monomers or derivatives thereof, such as styrene, 2-methyl styrene, 3-methyl styrene, 4-methyl styrene, 4-ethyl styrene, α-methyl styrene, chlorostyrene, bromostyrene, divinyl benzene, trivinyl benzene, 4-methoxystyrene, 4-cyanostyrene, 1-vinyl naphthalene, 2-vinyl naphthalene, 2-vinyl phenanthrene and styrene macromers; polymers of monomers selected from acrylic acid-based monomers or derivatives thereof, such as acrylic acid, methyl acrylate, ethyl acrylate, propyl acrylate, butyl acrylate, ethylhexyl acrylate, octyl acrylate, stearyl acrylate, lauryl acrylate, acrylonitrile, acrylamide, dimethylaminoethyl acrylate, methacrylic acid, methyl methacrylate, ethyl methacrylate, propyl methacrylate, butyl methacrylate, ethylhexyl methacrylate, octyl methacrylate, stearyl methacrylate, lauryl methacrylate, glycidyl methacrylate, methacrylonitrile, methacrylamide, dimethylaminoethyl methacrylate, itaconic acid, methyl itaconate, ethyl itaconate, fumaric acid, dimethyl fumarate, diethyl fumarate, maleic acid, dimethyl maleate, diethyl maleate, crotonic acid, methyl crotonate, ethyl crotonate and methyl methacrylate macromers; styrene acrylic resins in the form of a block copolymer, a random copolymer or a graft copolymer which are obtained by polymerization of two or more kinds of monomers, such as styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-maleic acid copolymers, styrene-maleic acid half-ester copolymers, styrene-maleic acid diester copolymers, acrylic acid-methacrylic acid copolymers, acrylic acid-methacrylic acid ester copolymers, styrene-α-methyl styrene-acrylic acid copolymers, styrene-methyl methacrylate-acrylic acid copolymers and styrene-methacrylic acid-acrylic acid copolymers; silicone resins, e.g., side chain-modified, one terminal end-modified, both terminal ends-modified, side chain- and both terminal ends-modified silicone oils, such as straight methyl silicone resins, methylphenyl silicone resins, epoxy-modified silicone resins, alkyd-modified silicone resins, polyester-modified silicone resins and acryl-modified silicone resins; polyester resins, e.g., polymers having an ester bond formed by reacting a dicarboxylic acid such as terephthalic acid, isophthalic acid, orthophthalic acid, 2,6-naphthalenedicarboxylic acid, sodium sulfo-isophthalate, succinic acid, adipic acid, azelaic acid, sebacic acid, 1,10-decanedicarboxylic acid and dimer acids or a tri- or higher-valent polycarboxylic acid such as trimellitic acid and pyromellitic acid with a dihydric alcohol such as ethylene glycol, 1,2-propylene glycol, 1,3-propylene glycol, 1,4-butanediol, 1,5-pentanediol, 1,6-hexanediol, 1,9-nonanediol, neopentyl glycol, 3-methyl-1,5-pentanediol, diethylene glycol, triethylene glycol, polytetraethylene glycol, 1,4-cyclohexane dimethanol and an ethyleneoxide adduct of bisphenol A or a tri- or higher-valent polyhydric alcohol such as trimethylol propane and pentaerythritol, as well as block copolymers, random copolymers or graft copolymers of these polymers; urethane resins, e.g., polymers having a urethane bond formed by reacting a polyol such as polypropylene glycol, polyethylene glycol, polytetramethylene glycol, poly(ethylene adipate), poly(diethylene adipate), poly(propylene adipate), poly(tetramethylene adipate), poly(hexamethylene adipate), poly-ε-caprolactone, poly(hexamethylene carbonate) and silicone polyols with an isocyanate such as tolylene diisocyanate, 4,4-diphenylmethane diisocyanate, xylylene diisocyanate, naphthalene diisocyanate, hexamethylene diisocyanate, hydrogenated tolylene diisocyanate, hydrogenated 4,4-diphenylmethane diisocyanate, isophorone diisocyanate and tetramethylxylylene diisocyanate, as well as block copolymers, random copolymers or graft copolymers of these polymers; copolymers between resins such as styrene acrylic resin-polyester resin copolymers and styrene acrylic resin-urethane resin copolymers.

In the curing step, the coated carrier core is heated to remove the solvent in the bio-based polymer and thereby fix the bio-based polymer on the surface of the carrier core.

The curing step may be conducted using a stationary furnace or a rotary furnace. Also, the coated carrier core may be directly heated while being held in the apparatus used in the coating step such as a universal stirrer, a wheel-type kneader, a blade-type kneader, a ball-type kneader, a roll-type kneader and a rolling fluidized bed coating device.

In the post-treatment step, the resulting magnetic composite particles are subjected to classification to remove a fine powder or coarse particles generated in the coating step and curing step therefrom and control the particle size and particle size distribution thereof as aimed. As the classifier for the post-treatment step, there may be used the same apparatuses as described in the process for producing the magnetic composite particles according to the above Invention 2.

Next, the magnetic carrier comprising the magnetic composite particles according to Invention 2 (i.e., Inventions 11 and 12) is described. Meanwhile, as to the magnetic carrier comprising the magnetic composite particles according to Invention 3 or 4 (Inventions 11 and 12), the magnetic composite particles according to Invention 3 or 4 by themselves may be directly used as the magnetic carrier.

Thus, the magnetic composite particles according to the present invention may be directly used as the magnetic carrier according to the present invention. When using the magnetic composite particles according to Invention 2, a coating layer may be formed on the surface of the respective magnetic composite particles in order to control a charge amount and an electrical resistivity thereof.

The coating layer may be formed of a coupling agent, inorganic particles or resins. These materials for the coating layer may be used alone or in combination of any two or more thereof. The coating amount of the coating layer is preferably 0.5 to 2.5% by weight based on the weight of the magnetic composite particles.

Examples of the coupling agent include silane-based coupling agents and titanium-based coupling agents. As the silane-based coupling agents, there may be used the same silane-based coupling agents as described in the process for producing the magnetic composite particles according to the above Invention 2. As the titanium-based coupling agents, there may also be used the same titanium-based coupling agents as described in the process for producing the magnetic composite particles according to the above Invention 3 or 4.

As the inorganic particles, there may be used those inorganic particles to be added to the bio-based polymer as described with respect to the magnetic composite particles according to the above Invention 3 or 4.

Examples of the resins include the above-mentioned bio-based polymers, as well as other bio-based polymers such as chitin, chitosan, alginic acid, amylose, sugars such as celluloses, polylactic acid, polyglycolic acid, poly(trimethylene terephthalate), ethyl cellulose, and poly-α-methylene-γ-butyrolactone. Further examples of the resins include those resins used for the pre-coating agent described in the process for producing the magnetic composite particles according to the above Invention 3 or 4.

The electrical resistivity of the magnetic carrier according to the present invention is preferably $1\times10^{7}$ to $1\times10^{17}$·cm, and more preferably $1\times10^{7}$ to $1\times10^{16}$·cm.

Next, the process for producing the magnetic carrier comprising the magnetic composite particles according to Invention 2 (Inventions 11 and 12) is described.

As the magnetic carrier comprising the magnetic composite particles according to Invention 2, there may be directly used the magnetic composite particles according to Invention 2. In order to control a charge amount and an electrical resistivity of the magnetic composite particles, a coating layer may be formed on the surface of the respective magnetic composite particles. In this case, a coupling agent, inorganic particles or resins may be suspended or dissolved as such in water or in an organic solvent, and the resulting suspension or solution may be applied on the surface of the magnetic composite particles using a mixing stirrer, a universal stirrer, a wheel-type kneader, a blade-type kneader, a ball-type kneader, a roll-type kneader and a rolling fluidized bed coating device, etc., to form a surface-coating layer thereon. In addition, after the coating, the resulting coated magnetic composite particles may be further subjected to drying, baking and classification, if required.

Next, the developer according to the present invention is described. In the developer according to the present invention, the magnetic composite particles or the magnetic carrier as described above may be directly used as such. Further, the magnetic composite particles or the magnetic carrier may be mixed with various magnetic toners or non-magnetic toners, and the resulting mixture may be used as the developer.

Next, the process for producing the developer according to the present invention is described. In the developer according to the present invention, the magnetic composite particles or the magnetic carrier as described above may be directly used as such. Further, in the case where the mixture obtained by mixing the magnetic composite particles or the magnetic carrier with various magnetic toners or non-magnetic toners is used as the developer, the developer may be prepared by mixing these components with each other using a ball mill, a paint conditioner, a stirring mixer, a tumbler-shaker-mixer, etc.

The magnetic composite particles according to the present invention are in the form of composite particles which are produced by coating the magnetic fine particles with the bio-based polymer to thereby form an aggregate of the magnetic fine particles using the bio-based polymer as a binder. In addition, the magnetic composite particles have a small bulk density and an excellent fluidity as compared to iron powder and ferrite, and therefore can exhibit a high durability by themselves or when used as a magnetic carrier or a developer. Also, the magnetic composite particles are produced through the granulation step and therefore can be readily reduced in particle size and are capable of forming developed images with a high quality. Further, since the bio-based polymer is used in the magnetic composite particles, the use of the magnetic composite particles is effective for reduction of environmental burden such as saving of underground sources and prevention of global warming, and further the magnetic composite particles exhibit a high safety to human bodies.

The magnetic carrier according to the present invention comprises the magnetic composite particles having the above-described properties, and therefore can exhibit a high durability and is capable of forming developed images with a high quality. Further, the use of the magnetic carrier according to the present invention is effective for reduction of environmental burden, and safe to human bodies.

The developer according to the present invention comprises the magnetic composite particles or the magnetic carrier having the above-mentioned properties and therefore can exhibit a high durability and is capable of forming developed images with a high quality. Further, the use of the developer according to the present invention is effective for reduction of environmental burden, and safe to human bodies.

EXAMPLES

Next, the present invention is described in more detail by Examples and Comparative Examples. Meanwhile, the terms "part(s)" and "%" in the following description mean "part(s) by mass" and "% by mass", respectively. Further, the following Examples are only illustrative and not intended to limit the invention thereto.

The infrared absorption spectra were data as measured using a Fourier transform infrared spectrophotometer "FTIR-8700" manufactured by Shimadzu Seisakusho Corp.

The average particle diameters of the magnetic fine particles and the magnetic composite particles were data of volume-median particle diameters as measured using a laser diffraction particle size distribution meter "LA-750" manufactured by Horiba Co, Ltd.

The BET specific surface area was data as measured using "Monosorb MS-21" manufactured by Yuasa Ionics Corp.

The weight-average molecular weight (Mw) of the polymer was data as measured by GPC method using a high-speed liquid chromatograph "LaCHrom Elite" manufactured by Hitachi Ltd., and an SEC column "TSK gel Multipore HXL-M" manufactured by Tosoh Corp.

The saturation magnetization was the value as measured using a sample vibration type magnetometer "VSM-3S-15" manufactured by Toei Kogyo Co., Ltd., by applying an external magnetic field of 795.8 kA/m (10 kOe).

The true specific gravity was the value as measured using a multi-volume density meter manufactured by Micromeritics Japane Co., Ltd.

The bulk density was measured by the method described in JIS K 5101.

The electrical resistivity (volume resistivity) was the value as measured (by applying a voltage of 100 V) using "High-Resistance Meter 4329A" manufactured by Yokogawa Hewlett Packard Corp.

The fluidity was determined from the fluidity coefficient as measured by the method described in JIS Z 2502, and the fluidity coefficient of not less than 20 (sec/50 g) was expressed by ○, whereas the fluidity coefficient of less than 20 (sec/50 g) was expressed by x.

The glass transition point was measured using a differential scanning calorimeter "DSC6200" manufactured by Seiko Instruments Inc.

The residual organic solvent (1,2-dichloroethane, etc.) in the magnetic composite particles was detected by quantitative determination using a gas chromatograph "Clarus 500" manufactured by Parkin Elmer Co., Ltd.

The X-ray diffraction was measured using an X-ray diffractometer "RINT 2500" manufactured by Rigaku Denki Co., Ltd.

The qualitative and quantitative analysis of metal components in the magnetic composite particles was carried out using an X-ray analyzer "RIX 2000" manufactured by Rigaku Denki Co., Ltd.

The reduction of environmental burden was evaluated according to the following ratings: ○: in the case where the material having less environmental burden was used; and x: in the case where the material having much environmental burden such as petroleum-derived polymers was used.

The safety to human bodies was evaluated according to the following ratings: ○: in the case where the polymer being safe to human bodies was used; and x: in the case where the polymer being unsafe to human bodies was used.

The durability was evaluated as follows. That is, the magnetic composite particles were charged into a tumbler-shaker-mixer "T2F" manufactured by Shinmaru Enterprise Corp., and shaken at 101 rpm for 2 hr to observe the surface of the magnetic composite particles before and after the shaking using a scanning electron microscope "S-4800" manufactured by Hitachi Ltd. The results were evaluated according to the following ratings.

x: Deterioration such as sticking, deformation and peeling in the particles was observed; ○: No change was observed.

The following various Examples, etc., relate to the magnetic composite particles according to Invention 2.

Toner Production Example 1-1

| | |
|---|---|
| Polyester resin | 100 parts by weight |
| Copper phthalocyanine | 5 parts by weight |
| Antistatic agent (quaternary ammonium salt) | 4 parts by weight |
| Low-molecular weight polyolefin | 3 parts by weight |

The above materials were fully pre-mixed with each other using a Henschel mixer, and then melt-kneaded in a twin-screw extrusion kneader. After being cooled, the obtained kneaded material was pulverized using a hammer mill and subjected to classification to thereby obtain positive-charged blue particles having a weight-average particle diameter of 7 μm.

Next, 100 parts by weight of the resulting positive-charged blue particles and 1 part by weight of hydrophobic silica were mixed with each other using a Henschel mixer, thereby obtaining a positive-charged cyan toner (a).

Toner Production Example 1-2

| | |
|---|---|
| Polyester resin | 100 parts by weight |
| Copper phthalocyanine | 5 parts by weight |
| Antistatic agent (zinc di-tert-butyl salicylate compound) | 3 parts by weight |
| Wax | 9 parts by weight |

The above materials were fully pre-mixed with each other using a Henschel mixer, and then melt-kneaded in a twin-screw extrusion kneader. After being cooled, the obtained kneaded material was pulverized using a hammer mill and subjected to classification to thereby obtain negative-charged blue particles having a weight-average particle diameter of 7 μm.

Next, 100 parts by weight of the resulting negative-charged blue particles and 1 part by weight of hydrophobic silica were mixed with each other using a Henschel mixer, thereby obtaining a negative-charged cyan toner (b).

Surface Treatment Step

Surface Treatment Example 1-1

A flask was charged with 100 parts by weight of spherical magnetite fine particles (having an average particle diameter of 230 nm), and the inside atmosphere of the flask was replaced with nitrogen. After fully stirring the magnetite fine particles, 1.5 parts by weight of stearic acid were added to the flask, and the contents of the flask were heated to 80° C., and intimately stirred in a nitrogen atmosphere for 30 min, thereby obtaining stearyl group-coated hydrophobic magnetic fine particles 1-1.

Surface Treatment Example 1-2

A flask was charged with 100 parts by weight of hexahedral magnetite fine particles (having an average particle diameter of 230 nm), and the inside atmosphere of the flask was replaced with nitrogen. After fully stirring the magnetite fine particles, the procedure was conducted under the same conditions as defined in Surface Treatment Example 1-1 for production of the hydrophobic magnetic fine particles 1-1 except that 1.2 parts by weight of decyl trimethoxysilane were added to the flask, thereby obtaining decylsilyl group-coated hydrophobic magnetic fine particles 1-2.

Surface Treatment Example 1-3

The procedure was conducted under the same conditions as defined in Surface Treatment Example 1-2 for production of the hydrophobic magnetic fine particles 1-2 except that 100 parts by weight of the hexahedral magnetite fine particles were replaced with octahedral magnetite fine particles (having an average particle diameter of 300 nm), thereby obtaining decylsilyl group-coated hydrophobic magnetic fine particles 1-3.

Example 1-1

Magnetic Composite Particles Produced Using Polylactic Acid

<Dispersion Step>

| | |
|---|---|
| Hydrophobic magnetic fine particles | 10 parts by weight |
| L-polylactic acid (Mw = 86,000) | 2 parts by weight |
| 1,2-Dichloroethane | 38 parts by weight |

The above materials were fully dispersed using an ultrasonic homogenizer "S-250D" manufactured by Branson Inc.

<Granulation Step>

The resulting dispersion was charged into 1000 parts by weight of water and suspended therein using a homomixer manufactured by Tokushu Kika Kogyo Co., Ltd., at 3,000 rpm, thereby obtaining a suspension comprising droplets having a size of about 40 μm. The resulting suspension was stirred using an agitation blade while bubbling with a nitrogen gas and heated to 90° C. to transpire 1,2-dichloroethane in the droplets (a whole amount of the vapor thus generated was collected to recover and reuse the 1,2-dichloroethane).

<Post-Treatment Step>

The resulting slurry was washed with water and then dried in vacuum, and passed through a sieve having a mesh size of 25 μm and a sieve having a mesh size of 100 μm to remove a fine powder and coarse particles therefrom, thereby obtaining magnetic composite particles according to the present invention. The thus obtained magnetic composite particles had an average particle diameter of 34 μm, a bulk density of 1.9 g/cm$^3$, a specific gravity of 3.2 g/cm$^3$, a saturation magnetization of 70 Am/kg, an electrical resistivity of $3.8\times10^8$ Ωcm and a BET specific surface area of 0.3 m$^2$/g (no residual 1,2-dichloroethane in the magnetic composite particles was detected).

The thus obtained magnetic composite particles were subjected to compositional analysis as follows. That is, the magnetic composite particles were sampled in an amount of 1.00 part by weight, and subjected to Soxhlet extraction using 1,2-dichloroethane to extract soluble components of the magnetic composite particles in 1,2-dichloroethane. The remaining insoluble components were present in an amount of 0.82 part by weight. As a result of subjecting the insoluble components to X-ray diffraction, the insoluble components were identified to be magnetite. In addition, the magnetite had a particle diameter of 220 nm. Further, it was confirmed that when floated on water, the fine particles were immiscible with water and therefore determined to be hydrophobic.

Next, the 1,2-dichloroethane extract solution was mixed with methanol so that a white precipitate was produced. The thus obtained white precipitate was dried to measure its amount, so that it was confirmed that the amount of the dried precipitate was 0.18 part by weight. As a result of subjecting the white precipitate to measurement of infrared absorption spectrum, the white precipitate was identified to be polylactic acid. In addition, as a result of measuring a weight-average molecular weight of the polylactic acid, it was confirmed that the polylactic acid had a weight-average molecular weight of 86,000. Further, it was confirmed that the content of the magnetic fine particles in the magnetic composite particles was 82% by weight, and had a glass transition point of 56° C.

Example 1-2 to Example 1-12

The same procedure as defined in Example 1-1 was conducted except that the kind and amount of the hydrophobic magnetic fine particles, the kind and amount of the bio-based polymer, the kind and amount of the organic solvent, and the suspending speed, were changed variously, thereby obtaining magnetic composite particles.

Comparative Example 1-1

In which a Petroleum-Derived Polymer was Used

The same procedure as defined in Example 1-1 was conducted except that a styrene-methyl methacrylate copolymer (weight-average molecular weight: 80,000) was used in place of the L-polylactic acid, thereby obtaining magnetic composite particles. As a result, it was confirmed that the resulting magnetic composite particles had an average particle diameter of 30 μm. However, since no environmental burden was taken into consideration owing to use of the petroleum-derived polymer, the magnetic composite particles were less effective for reduction of environmental burden such as saving of underground sources and prevention of global warming.

Comparative Example 1-2

In which the Magnetic Composite Particles had a Small Particle Diameter

The same procedure as defined in Example 1-1 was conducted except that the suspending speed in the homomixer was changed to 12,000 rpm, thereby obtaining magnetic composite particles. As a result, it was confirmed that the resulting magnetic composite particles had an average particle diameter of 8 μm and therefore failed to exhibit a good fluidity as particles suitable for electrophotographic development due to such a small particle diameter.

Comparative Example 1-3

In which a Content of the Magnetic Fine Particles was Small

| | |
|---|---|
| Hydrophobic magnetic fine particles 1-1 | 5 parts by weight |
| Polylactic acid (Mw = 86,000) | 7 parts by weight |
| 1,2-dichloroethane | 38 parts by weight |

The same procedure as defined in Example 1-1 was conducted except that the above materials were blended together, thereby obtaining magnetic composite particles. As a result, it was confirmed that the resulting magnetic composite particles had an average particle diameter of 35 μm, and failed to exhibit sufficient magnetic properties owing to a less content of the magnetic fine particles therein and were therefore unsuitable for electrophotographic development.

Comparative Example 1-4

In which the Petroleum-Derived Polymer and a Natural Polymer-Based Polysaccharide were Used

| | |
|---|---|
| Styrene-butyl methacrylate copolymer (styrene components: 70 parts) | 40 parts by weight |
| Natural polymer-based polysaccharide as biodegradable substance ("ECOSTAR" (tradename) produced by Hagiwara Industries Inc.) | 10 parts by weight |
| Triiron tetraoxide ("MTA-740" (tradename) produced by Toda Kogyo Corp.) | 60 parts by weight |
| Carbon black ("BPL" produced by Cabot Corp.) | 3.5 parts by weight |

The above materials were melt-kneaded, cooled and then pulverized to obtain magnetic fine particles. The thus obtained magnetic fine particles were classified using an air classifier, thereby obtaining a magnetic carrier in the form of fine particles having an average particle diameter of 40 μm. However, in this case, since no environmental burden was taken into consideration owing to use of the petroleum-derived polymer, the resulting magnetic composite particles were less effective for reduction of environmental burden such as saving of underground sources and prevention of global warming. In addition, the magnetic composite particles failed to exhibit sufficient magnetic properties owing to a less content of the magnetic fine particles therein and therefore were unsuitable for electrophotographic development. Further, the polymer used in the magnetic composite particles had a glass transition point of 0° C.

Comparative Example 1-5

In which a 3-hydroxybutyrate-3-hydroxyvalerate Copolymer was Used

| | |
|---|---|
| 3-Hydroxybutyrate-3-hydroxyvalerate copolymer (average molecular weight: 40,000) | 100 parts by weight |
| Magnetite | 400 parts by weight |

The above materials were mixed with each other using a Henschel mixer and further melt-kneaded using a twin-roll mill, and then pulverized and classified to obtain a binder-type carrier having an average particle diameter of 50 μm. However, the resulting particles were too soft and therefore deteriorated in durability. Also, the polymer used in the carrier had a glass transition point of −1° C.

Comparative Example 1-6

In which an Alloy of Starch and Polyvinyl Alcohol was Used

| | |
|---|---|
| Alloy of starch and modified polyvinyl alcohol (average molecular weight: 30,000) | 100 parts by weight |
| Magnetite | 400 parts by weight |

The same procedure as defined in Comparative Example 1-6 was conducted except that the above materials were used as raw materials, thereby obtaining a binder-type carrier having an average particle diameter of 40 μm. However, the resulting particles were too soft and therefore deteriorated in durability. Also, the polymer used in the carrier had a glass transition point of 20° C.

Comparative Example 1-7

In which Poly(Butylene Succinate) was Used

| | |
|---|---|
| Poly(butylene succinate) (average molecular weight: 50,000) | 100 parts by weight |
| Magnetite | 400 parts by weight |

The same procedure as defined in Comparative Example 1-6 was conducted except that the above materials were used as raw materials, thereby obtaining a binder-type carrier having an average particle diameter of 60 μm. However, the resulting particles were too soft and therefore deteriorated in fluidity. Also, the polymer used in the carrier had a glass transition point of −40° C.

Comparative Example 1-8

In which Poly(Butylene Succinate) and a Styrene-Acryl-Based Copolymer were Used

| | |
|---|---|
| Poly(butylene succinate) (average molecular weight: 50,000) | 60 parts by weight |
| Styrene-acryl-based copolymer | 40 parts by weight |
| Magnetite | 400 parts by weight |

The same procedure as defined in Comparative Example 1-6 was conducted except that the above materials were used as raw materials, thereby obtaining a binder-type carrier having an average particle diameter of 60 μm. However, the resulting particles were too soft and therefore deteriorated in fluidity. Also, the polymer used in the carrier had a glass transition point of −40° C.

The production conditions of the thus obtained magnetic composite particles are shown in Table 1, and various properties of the magnetic composite particles are shown in Table 2.

TABLE 1

| Magnetic composite particles Kind | Magnetic fine particles Kind | Content (%) |
|---|---|---|
| Example 1-1 | Magnetic fine particles 1-1 | 82 |
| Example 1-2 | Magnetic fine particles 1-1 | 77 |
| Example 1-3 | Magnetic fine particles 1-2 | 91 |
| Example 1-4 | Magnetic fine particles 1-3 | 76 |
| Example 1-5 | Magnetic fine particles 1-1 | 84 |
| Example 1-6 | Magnetic fine particles 1-1 | 94 |
| Example 1-7 | Magnetic fine particles 1-2 | 81 |
| Example 1-8 | Magnetic fine particles 1-3 | 85 |
| Example 1-9 | Magnetic fine particles 1-3 | 90 |
| Example 1-10 | Magnetic fine particles 1-1 | 82 |
| Example 1-11 | Magnetic fine particles 1-2 | 77 |
| Example 1-12 | Magnetic fine particles 1-3 | 90 |
| Comp. Example 1-1 | Magnetic fine particles 1-1 | 82 |
| Comp. Example 1-2 | Magnetic fine particles 1-1 | 82 |
| Comp. Example 1-3 | Magnetic fine particles 1-1 | 42 |
| Comp. Example 1-4 | Triiron tetraoxide | 53 |
| Comp. Example 1-5 | Magnetite | 80 |
| Comp. Example 1-6 | Magnetite | 80 |
| Comp. Example 1-7 | Magnetite | 80 |
| Comp. Example 1-8 | Magnetite | 80 |

| Magnetic composite particles Kind | Polymer Kind | Molecular weight |
|---|---|---|
| Example 1-1 | L-polylactic acid | 86,000 |
| Example 1-2 | L-polylactic acid | 5,000 |
| Example 1-3 | L-polylactic acid | 300,000 |
| Example 1-4 | Ethyl cellulose | 30,000 |
| Example 1-5 | Polyglycolic acid | 30,000 |
| Example 1-6 | Poly(trimethylene terephthalate) | 40,000 |
| Example 1-7 | Poly-α-methylene-γ-butyrolactone | 40,000 |
| Example 1-8 | D- and L-polylactic acid copolymer | 55,000 |
| Example 1-9 | L-polylactic acid-polyglycolic acid copolymer | 20,000 |
| Example 1-10 | L-polylactic acid + D-polylactic acid | 86,000 + 30,000 |
| Example 1-11 | D- and L-polylactic acid copolymer + poly(trimethylene terephthalate) | 55,000 + 40,000 |
| Example 1-12 | L-polylactic acid + poly(trimethylene terephthalate) + poly-α-methylene-γ-butyrolactone | 86,000 + 40,000 + 40,000 |
| Comp. Example 1-1 | Styrene-MMA copolymer | 50,000 |
| Comp. Example 1-2 | L-polylactic acid | 86,000 |
| Comp. Example 1-3 | L-polylactic acid | 86,000 |
| Comp. Example 1-4 | "Ecostar" + styrene-butyl methacrylate copolymer | 100,000 + 10,000 |
| Comp. Example 1-5 | 3-hydroxybutyrate-3-hydroxyvalerate copolymer | 40,000 |
| Comp. Example 1-6 | Alloy of starch and polyvinyl alcohol | 30,000 |
| Comp. Example 1-7 | Poly(butylene succinate) | 50,000 |
| Comp. Example 1-8 | Poly(butylene succinate) + styrene-acryl-based copolymer | 50,000 + 10,000 |

TABLE 2

| | Properties of magnetic composite particles | | | |
|---|---|---|---|---|
| | Average particle diameter (μm) | Content of magnetic fine particles (%) | Bulk density ($gcm^{-3}$) | Specific gravity ($gcm^{-3}$) |
| Example 1-1 | 34 | 82 | 1.9 | 3.2 |
| Example 1-2 | 40 | 77 | 1.7 | 3.0 |
| Example 1-3 | 51 | 91 | 2.5 | 3.4 |
| Example 1-4 | 22 | 76 | 1.6 | 2.7 |
| Example 1-5 | 35 | 84 | 2.0 | 3.4 |
| Example 1-6 | 20 | 94 | 2.4 | 3.5 |
| Example 1-7 | 38 | 81 | 2.0 | 3.1 |
| Example 1-8 | 54 | 85 | 1.6 | 2.8 |
| Example 1-9 | 62 | 90 | 2.4 | 3.5 |
| Example 1-10 | 38 | 82 | 1.9 | 3.1 |
| Example 1-11 | 50 | 77 | 1.7 | 2.8 |
| Example 1-12 | 40 | 90 | 2.0 | 3.4 |
| Comp. Example 1-1 | 30 | 82 | 2.0 | 3.2 |
| Comp. Example 1-2 | 8 | 82 | 2.0 | 3.2 |
| Comp. Example 1-3 | 30 | 42 | 1.5 | 2.0 |
| Comp. Example 1-4 | 40 | 53 | 3.0 | 4.5 |
| Comp. Example 1-5 | 50 | 80 | 2.1 | 3.0 |
| Comp. Example 1-6 | 40 | 80 | 2.0 | 3.0 |
| Comp. Example 1-7 | 60 | 80 | 2.0 | 3.0 |
| Comp. Example 1-8 | 60 | 80 | 2.0 | 3.0 |

| | Properties of magnetic composite particles | | |
|---|---|---|---|
| | Saturation magnetization ($Am^2kg^{-1}$) | Electrical resistivity (·cm) | BET ($m^2g^{-1}$) |
| Example 1-1 | 70 | $3.8 \times 10^8$ | 0.3 |
| Example 1-2 | 66 | $5.1 \times 10^8$ | 0.3 |
| Example 1-3 | 78 | $9.5 \times 10^7$ | 0.2 |
| Example 1-4 | 54 | $2.1 \times 10^9$ | 0.5 |
| Example 1-5 | 72 | $4.8 \times 10^8$ | 0.3 |
| Example 1-6 | 80 | $1.2 \times 10^8$ | 0.8 |
| Example 1-7 | 70 | $3.0 \times 10^8$ | 0.2 |
| Example 1-8 | 58 | $8.8 \times 10^8$ | 0.3 |
| Example 1-9 | 75 | $9.8 \times 10^7$ | 0.1 |
| Example 1-10 | 70 | $3.0 \times 10^8$ | 0.3 |
| Example 1-11 | 65 | $7.0 \times 10^8$ | 0.1 |
| Example 1-12 | 79 | $9.0 \times 10^7$ | 0.2 |
| Comp. Example 1-1 | 70 | $3.8 \times 10^8$ | 0.3 |
| Comp. Example 1-2 | 70 | $3.8 \times 10^8$ | 1.2 |
| Comp. Example 1-3 | 34 | $4.0 \times 10^9$ | 0.3 |
| Comp. Example 1-4 | 45 | $1.0 \times 10^{10}$ | 0.1 |
| Comp. Example 1-5 | 70 | $1.0 \times 10^7$ | 0.1 |
| Comp. Example 1-6 | 69 | $1.0 \times 10^7$ | 0.1 |
| Comp. Example 1-7 | 71 | $1.0 \times 10^7$ | 0.1 |
| Comp. Example 1-8 | 70 | $1.0 \times 10^7$ | 0.1 |

TABLE 2-continued

| | Properties of magnetic composite particles | | |
|---|---|---|---|
| | Kind of polymer | Glass transition point of polymer (° C.) | Molecular weight of polymer |
| Example 1-1 | L-polylactic acid | 56 | 86,000 |
| Example 1-2 | L-polylactic acid | 56 | 5,000 |
| Example 1-3 | L-polylactic acid | 56 | 300,000 |
| Example 1-4 | Ethyl cellulose | 43 | 30,000 |
| Example 1-5 | Polyglycolic acid | 45 | 30,000 |
| Example 1-6 | Poly(trimethylene terephthalate) | 51 | 40,000 |
| Example 1-7 | Poly-α-methylene-γ-butyrolactone | >180 | 40,000 |
| Example 1-8 | D- and L-polylactic acid copolymer | 56 | 55,000 |
| Example 1-9 | L-polylactic acid-polyglycolic acid copolymer | 47 | 20,000 |
| Example 1-10 | L-polylactic acid + D-polylactic acid | 57 | 86,000 + 30,000 |
| Example 1-11 | D- and L-polylactic acid copolymer + poly(trimethylene terephthalate) | 51 | 55,000 + 40,000 |
| Example 1-12 | L-polylactic acid + poly(trimethylene terephthalate) + poly-α-methylene-γ-butyrolactone | 51 | 86,000 + 40,000 + 40,000 |
| Comp. Example 1-1 | Styrene-MMA copolymer | 80 | 50,000 |
| Comp. Example 1-2 | L-polylactic acid | 56 | 86,000 |
| Comp. Example 1-3 | L-polylactic acid | 56 | 86,000 |
| Comp. Example 1-4 | "Ecostar" + styrene-butyl methacrylate copolymer | 0 | 100,000 + 10,000 |
| Comp. Example 1-5 | 3-hydroxybutyrate-3-hydroxyvalerate copolymer | −1 | 40,000 |
| Comp. Example 1-6 | Alloy of starch and polyvinyl alcohol | 20 | 30,000 |
| Comp. Example 1-7 | Poly(butylene succinate) | −40 | 50,000 |
| Comp. Example 1-8 | Poly(butylene succinate) + styrene-acryl-based copolymer | −40 | 50,000 + 10,000 |

| | Properties of magnetic composite particles | | | |
|---|---|---|---|---|
| | Fluidity | Durability | Effect of reducing environmental burden | Safety to human bodies |
| Example 1-1 | ○ | ○ | ○ | ○ |
| Example 1-2 | ○ | ○ | ○ | ○ |
| Example 1-3 | ○ | ○ | ○ | ○ |
| Example 1-4 | ○ | ○ | ○ | ○ |
| Example 1-5 | ○ | ○ | ○ | ○ |
| Example 1-6 | ○ | ○ | ○ | ○ |
| Example 1-7 | ○ | ○ | ○ | ○ |
| Example 1-8 | ○ | ○ | ○ | ○ |
| Example 1-9 | ○ | ○ | ○ | ○ |
| Example 1-10 | ○ | ○ | ○ | ○ |
| Example 1-11 | ○ | ○ | ○ | ○ |
| Example 1-12 | ○ | ○ | ○ | ○ |
| Comp. Example 1-1 | ○ | ○ | x | x |
| Comp. Example 1-2 | x | ○ | ○ | ○ |
| Comp. Example 1-3 | ○ | ○ | ○ | ○ |
| Comp. Example 1-4 | ○ | x | x | x |

TABLE 2-continued

| | | | | |
|---|---|---|---|---|
| Example 1-4 | | | | |
| Comp. Example 1-5 | x | x | ○ | ○ |
| Comp. Example 1-6 | ○ | x | ○ | ○ |
| Comp. Example 1-7 | x | ○ | ○ | ○ |
| Comp. Example 1-8 | x | ○ | x | x |

As shown in Tables 1 and 2, the magnetic composite particles according to the present invention in which the bio-based polymer was used were effective for reduction of environmental burden such as saving of underground sources and prevention of global warming, were safe to human bodies, and exhibited a high durability. In addition, the magnetic composite particles according to the present invention had a small bulk density and an excellent fluidity, and therefore were apparently very excellent in properties when used as a raw material for magnetic carriers, a magnetic carrier or a developer. Further, the magnetic composite particles according to the present invention were produced through the granulation step and therefore suitable for attaining a high image quality.

Magnetic Carrier

Example 1-13 to [Example 1-24] and [Comparative Example 1-9] to Comparative Example 1-16

The magnetic composite particles and a toner were blended with each other at the following mixing ratio, and the resulting mixture was shaken for a predetermined period of time using a tumbler-shaker-mixer "T2F" manufactured by Shinmaru Enterprise Corp., to measure a charge amount on the toner and thereby evaluate a performance of the magnetic composite particles as a magnetic carrier.

| | |
|---|---|
| Magnetic carrier (magnetic composite particles) | 92 parts by weight |
| Toner | 8 parts by weight |

The charge amount of the toner was measured using a blow-off charge amount measuring device "TB-200" manufactured by Kyocera Chemical Corp. The rate of change in the charge amount was expressed by the percentage calculated by multiplying the value obtained by dividing a difference between an initial charge amount after shaken for 1 min and a charge amount after shaken for 2 hr by the initial charge amount, by 100. The results are shown in Table 3.

TABLE 3

| Magnetic carrier Kind | Magnetic composite particles Kind | Toner Kind | Properties Rate of change in charge amount (%) |
|---|---|---|---|
| Example 1-13 | Example 1-1 | Cyan toner (a) | 5 |
| Example 1-14 | Example 1-2 | Cyan toner (a) | 5 |
| Example 1-15 | Example 1-3 | Cyan toner (a) | 6 |
| Example 1-16 | Example 1-4 | Cyan toner (a) | 9 |
| Example 1-17 | Example 1-5 | Cyan toner (a) | 10 |
| Example 1-18 | Example 1-6 | Cyan toner (a) | 8 |
| Example 1-19 | Example 1-7 | Cyan toner (b) | 9 |
| Example 1-20 | Example 1-8 | Cyan toner (a) | 8 |
| Example 1-21 | Example 1-9 | Cyan toner (a) | 8 |

TABLE 3-continued

| Magnetic carrier Kind | Magnetic composite particles Kind | Toner Kind | Properties Rate of change in charge amount (%) |
|---|---|---|---|
| Example 1-22 | Example 1-10 | Cyan toner (a) | 5 |
| Example 1-23 | Example 1-11 | Cyan toner (a) | 8 |
| Example 1-24 | Example 1-12 | Cyan toner (a) | 3 |
| Comp. Example 1-9 | Comp. Example 1-1 | Cyan toner (b) | 5 |
| Comp. Example 1-10 | Comp. Example 1-2 | Cyan toner (a) | Not measurable |
| Comp. Example 1-11 | Comp. Example 1-3 | Cyan toner (a) | 5 |
| Comp. Example 1-12 | Comp. Example 1-4 | Cyan toner (a) | 30 |
| Comp. Example 1-13 | Comp. Example 1-5 | Cyan toner (a) | 55 |
| Comp. Example 1-14 | Comp. Example 1-6 | Cyan toner (a) | 83 |
| Comp. Example 1-15 | Comp. Example 1-7 | Cyan toner (a) | 60 |
| Comp. Example 1-16 | Comp. Example 1-8 | Cyan toner (a) | 120 |

Magnetic Carrier

Formation of Surface-Coating Layer

Example 1-25

One hundred parts by weight of the magnetic composite particles (Example 1-1) were charged into a mixing stirrer "5XDML-03-r" manufactured by Dalton Corp., and stirred therein at 40° C. A solution prepared by dissolving 1 part by weight of ethyl cellulose (Mw=30,000) in 20 parts by weight of ethyl acetate was added to the magnetic composite particles, and the resulting mixture was stirred at 40° C. for 2 hr under a nitrogen gas flow (a whole amount of vapor of ethyl acetate was collected to recover and reuse the ethyl acetate). Thereafter, the contents of the stirrer were heated to 80° C. and stirred for 2 hr. The resulting particles were passed through a sieve having a mesh size of 25 μm and a sieve having a mesh size of 100 μm to remove a fine powder and coarse particles therefrom, thereby obtaining a magnetic carrier according to the present invention (formation of a surface-coating layer). As a result, it was confirmed that the thus obtained magnetic carrier had an electrical resistivity of $4.0\times10^{12}\cdot$cm. Further, the magnetic carrier was mixed with the toner in the same manner as defined previously to measure a charge amount of the toner. As a result, it was confirmed that the rate of change in charge amount of the toner was 5%.

Example 1-26

The same procedure as defined in Example 1-25 was conducted except that a dispersion prepared by adding 0.1 part by weight of carbon black (average particle diameter: 20 nm) to a solution prepared by dissolving 1 part by weight ethyl cellulose in 20 parts by weight of ethyl acetate and then fully dispersing the resulting mixture using an ultrasonic homogenizer was used, thereby obtaining a magnetic carrier according to the present invention (formation of a surface-coating layer). As a result, it was confirmed that the thus obtained magnetic carrier had an electrical resistivity of $2.0\times10^{11}\cdot$cm, and the rate of change in charge amount of the toner was 7%.

Example 1-27 to Example 1-35

The same procedure as defined in Examples 1-26 and 1-27 was conducted except that the kind and amount of the magnetic carrier (magnetic composite particles), the kind and amount of the resin, the kind and amount of the inorganic fine particles, and the kind and amount of the organic solvent, were changed variously, thereby obtaining magnetic carriers (formation of a surface-coating layer). The results are shown in Table 4.

TABLE 4

| Magnetic carrier Kind | Magnetic composite particles Kind | Coating layer: Coupling agent and resin | Coating layer: Molecular weight | Coating layer: Coating amount (%) |
|---|---|---|---|---|
| Example 1-25 | Example 1-1 | Ethyl cellulose | 30,000 | 1.0 |
| Example 1-26 | Example 1-1 | Ethyl cellulose | 30,000 | 1.0 |
| Example 1-27 | Example 1-4 | L-polylactic acid | 86,000 | 1.0 |
| Example 1-28 | Example 1-5 | L-polylactic acid | 86,000 | 1.0 |
| Example 1-29 | Example 1-6 | Chitosan | 50,000 | 1.8 |
| Example 1-30 | Example 1-7 | Alginic acid | 50,000 | 1.5 |
| Example 1-31 | Example 1-10 | Poly(methyl methacrylate) | 40,000 | 0.5 |
| Example 1-32 | Example 1-10 | Poly(styrene-maleic acid) | 80,000 | 1.2 |
| Example 1-33 | Example 1-10 | Acryl-modified silicone | Not measurable due to curable resin | 0.8 |
| Example 1-34 | Example 1-11 | Aminopropyl triethoxysilane + methyl straight silicone | Not measurable due to curable resin | 1.0 |
| Example 1-35 | Example 1-12 | Aminopropyl triethoxysilane + methyl phenyl silicone + poly(styrene-maleic acid) | Not measurable due to curable resin | 2.2 |

| Magnetic carrier Kind | Coating layer: Inorganic fine particles | Coating layer: Amount added (%) | Electrical resistivity (·cm) | Toner: Kind | Toner: Rate of change in charge amount (%) |
|---|---|---|---|---|---|
| Example 1-25 | — | — | $4.0 \times 10^{12}$ | Cyan toner (a) | 5 |
| Example 1-26 | Carbon black | 0.1 | $2.0 \times 10^{11}$ | Cyan toner (a) | 7 |
| Example 1-27 | — | — | $1.5 \times 10^{13}$ | Cyan toner (a) | 2 |
| Example 1-28 | Carbon black | 0.1 | $8.2 \times 10^{11}$ | Cyan toner (a) | 5 |
| Example 1-29 | Carbon black | 0.3 | $2.4 \times 10^{13}$ | Cyan toner (a) | 9 |
| Example 1-30 | — | — | $7.3 \times 10^{12}$ | Cyan toner (b) | 4 |
| Example 1-31 | — | — | $9.5 \times 10^{10}$ | Cyan toner (a) | 12 |
| Example 1-32 | — | — | $1.8 \times 10^{13}$ | Cyan toner (b) | 4 |
| Example 1-33 | Alumina | 0.05 | $7.7 \times 10^{12}$ | Cyan toner (a) | 10 |
| Example 1-34 | Titanium oxide | 0.1 | $3.6 \times 10^{12}$ | Cyan toner (a) | 5 |
| Example 1-35 | Silica | 0.2 | $3.6 \times 10^{15}$ | Cyan toner (a) | 5 |

As shown in Tables 3 and 4, the magnetic carriers according to the present invention apparently exhibited a high durability. Also, it was apparently recognized that the magnetic carriers in which the bio-based polymer was used were effective for reduction of environmental burden such as saving of underground sources and prevention of global warming, and were safe to human bodies.

[Developer]

The magnetic carrier and a toner were blended with each other at the following mixing ratio, and the resulting mixture was mixed using a universal ball mill "UB-32" manufactured by Yamato Scientific Co., Ltd., to obtain a developer.

| | |
|---|---|
| Magnetic composite particles | 92 parts by weight |
| Toner | 8 parts by weight |

The thus obtained developer and the toner were subjected to a printing test in which characters and solid images were printed using a printer "LS-05016N" manufactured by Kyocera Mita Corp. The image clarity was evaluated according to the following ratings: ○: beautiful image quality was attained on the first printed image; and x: thin spots of the characters and unevenness of the solid image were observed even on the first printed image. In addition, the image durability was evaluated according to the following ratings: ○: 1000 sheets were printed without deterioration in image quality; Δ: 500 sheets were printed without deterioration in image quality; and x: deterioration in image quality occurred when less than 500 sheets were printed. The results are shown in Table 5.

TABLE 5

| Developer Kind | Magnetic carrier Kind | Toner Kind | Properties of developer: Image clarity | Properties of developer: Image durability |
|---|---|---|---|---|
| Example 1-36 | Example 1-13 | Cyan toner (a) | ○ | ○ |
| Example 1-37 | Example 1-14 | Cyan toner (a) | ○ | Δ |
| Example 1-38 | Example 1-15 | Cyan toner (a) | ○ | ○ |
| Example 1-39 | Example 1-16 | Cyan toner (a) | ○ | ○ |
| Example 1-40 | Example 1-17 | Cyan toner (a) | ○ | ○ |
| Example 1-41 | Example 1-18 | Cyan toner (a) | ○ | ○ |
| Example 1-42 | Example 1-19 | Cyan toner (b) | ○ | ○ |
| Example 1-43 | Example 1-20 | Cyan toner (a) | ○ | Δ |
| Example 1-44 | Example 1-21 | Cyan toner (a) | ○ | Δ |
| Example 1-45 | Example 1-22 | Cyan toner (a) | ○ | ○ |
| Example 1-46 | Example 1-23 | Cyan toner (a) | Δ | ○ |
| Example 1-47 | Example 1-24 | Cyan toner (a) | Δ | ○ |
| Example 1-48 | Example 1-25 | Cyan toner (a) | ○ | ○ |
| Example 1-49 | Example 1-26 | Cyan toner (a) | ○ | ○ |
| Example 1-50 | Example 1-27 | Cyan toner (a) | ○ | ○ |
| Example 1-51 | Example 1-28 | Cyan toner (a) | ○ | ○ |
| Example 1-52 | Example 1-29 | Cyan toner (a) | ○ | ○ |
| Example 1-53 | Example 1-30 | Cyan toner (b) | ○ | Δ |
| Example 1-54 | Example 1-31 | Cyan toner (a) | ○ | Δ |
| Example 1-55 | Example 1-32 | Cyan toner (b) | ○ | ○ |
| Example 1-56 | Example 1-33 | Cyan toner (a) | ○ | ○ |
| Example 1-57 | Example 1-34 | Cyan toner (a) | ○ | ○ |
| Example 1-58 | Example 1-35 | Cyan toner (a) | ○ | ○ |
| Comp. Example 1-17 | Comp. Example 1-9 | Cyan toner (b) | ○ | ○ |
| Comp. Example 1-18 | Comp. Example 1-10 | Cyan toner (a) | x | x |
| Comp. Example 1-19 | Comp. Example 1-11 | Cyan toner (a) | x | x |
| Comp. Example 1-20 | Comp. Example 1-12 | Cyan toner (a) | x | x |
| Comp. Example 1-21 | Comp. Example 1-13 | Cyan toner (a) | x | x |
| Comp. Example 1-22 | Comp. Example 1-14 | Cyan toner (a) | x | x |
| Comp. Example 1-23 | Comp. Example 1-15 | Cyan toner (a) | x | x |
| Comp. Example 1-24 | Comp. Example 1-16 | Cyan toner (a) | x | x |

As shown in Table 5, the developer according to the present invention apparently exhibited a high image clarity and a high image durability. Also, it was apparently recognized that the developer according to the present invention in which the bio-based polymer was used was effective for reduction of environmental burden such as saving of underground sources and prevention of global warming, and was safe to human bodies.

The following various Examples, etc., also relate to the magnetic composite particles according to Invention 2.

Toner Production Example 2-1

| | |
|---|---|
| Polyester resin | 100 parts by weight |
| Copper phthalocyanine | 5 parts by weight |
| Antistatic agent (quaternary ammonium salt) | 4 parts by weight |
| Low-molecular weight polyolefin | 3 parts by weight |

The above materials were fully pre-mixed with each other using a Henschel mixer, and then melt-kneaded in a twin-screw extrusion kneader. After being cooled, the obtained kneaded material was pulverized using a hammer mill and subjected to classification to thereby obtain positive-charged blue particles having a weight-average particle diameter of 7 μm.

Next, 100 parts by weight of the resulting positive-charged blue particles and 1 part by weight of hydrophobic silica were mixed with each other using a Henschel mixer, thereby obtaining a positive-charged cyan toner (p).

Toner Production Example 2-2

| | |
|---|---|
| Polyester resin | 100 parts by weight |
| Copper phthalocyanine | 5 parts by weight |
| Antistatic agent (zinc di-tert-butyl salicylate compound) | 3 parts by weight |
| Wax | 9 parts by weight |

The above materials were fully pre-mixed with each other using a Henschel mixer, and then melt-kneaded in a twin-screw extrusion kneader. After being cooled, the obtained kneaded material was pulverized using a hammer mill and subjected to classification to thereby obtain negative-charged blue particles having a weight-average particle diameter of 7 μm.

Next, 100 parts by weight of the resulting negative-charged blue particles and 1 part by weight of hydrophobic silica were mixed with each other using a Henschel mixer, thereby obtaining a negative-charged cyan toner (n).

Example 2-1

Chitin-Based Magnetic Composite Particles

<Dispersion Step>

| | |
|---|---|
| Spherical magnetite fine particles (average particle diameter: 230 nm) | 10.0 parts by weight |
| Chitin (produced by Nacalai Tesque, Inc.) | 2.0 parts by weight |
| Methanol/calcium chloride dihydrate saturated solution | 988.0 parts by weight |

The above materials were fully dispersed using an ultrasonic homogenizer "S-250D" manufactured by Branson Inc.

<Granulation Step>

The resulting dispersion was sprayed in 2000 parts by weight of water using a sprayer (nozzle diameter: 0.1 mm) to obtain a hydrogel of the magnetic composite particles.

<Post-Treatment Step>

The resulting hydrogel was washed with water and then dried in vacuum, and passed through a sieve having a mesh size of 25 μm and a sieve having a mesh size of 100 μm to remove a fine powder and coarse particles therefrom, thereby obtaining magnetic composite particles.

The thus obtained magnetic composite particles had an average particle diameter of 32 μm, a bulk density of 1.9 g/cm$^3$, a specific gravity of 3.2 g/cm$^3$, a saturation magnetization of 70 Am/kg, an electrical resistivity of $3.8\times10^8$ Ωcm and a BET specific surface area of 0.3 m$^2$ m$^2$/g. As a result of a fluorescent X-ray measurement, it was confirmed that the metal component other than magnetite in the magnetic composite particles was calcium, and the content of calcium in the magnetic composite particles was 0.5% by weight.

The thus obtained magnetic composite particles were subjected to compositional analysis as follows. That is, the magnetic composite particles were sampled in an amount of 1.00 part by weight and added into 100 parts by weight of the methanol/calcium chloride saturated solution, followed by heating and stirring the resulting mixture, to thereby extract resin components in the methanol/calcium chloride saturated solution. The remaining insoluble components were present in an amount of 0.82 part by weight. As a result of subjecting the insoluble components to X-ray diffraction analysis, the insoluble components were identified to be magnetite. In addition, the magnetite had a particle diameter of 230 nm.

Next, the methanol/calcium chloride saturated solution as an extract solution was mixed with a large amount of pure water so that a white precipitate was produced. The thus obtained white precipitate was dried to measure its amount, so that it was confirmed that the amount of the dried precipitate was 0.17 part by weight. As a result of subjecting the white precipitate to measurement of infrared absorption spectrum, the white precipitate was identified to be chitin. Further, it was confirmed that the content of the magnetic fine particles in the magnetic composite particles was 82% by weight.

Example 2-2 to Example 2-5

The same procedure as defined in Example 2-1 was conducted except that the kind and amount of the hydrophobic magnetic fine particles, the amount of the bio-based polymer, the sprayer used, and the nozzle diameter of the sprayer, were changed variously, thereby obtaining magnetic composite particles.

Example 2-6

Chitosan/Alginic Acid Composite Material-Based Magnetic Composite Particles)

<Dispersion Step>

| | |
|---|---|
| Spherical magnetite fine particles (average particle diameter: 230 nm) | 10.0 parts by weight |
| Alginic acid (produced by Wako Pure Chemical Industries, Ltd.) | 0.2 part by weight |
| Pure water | 989.8 parts by weight |

The above materials were fully dispersed using an ultrasonic homogenizer "S-250D" manufactured by Branson Inc.

<Granulation Step>

To a solution prepared by dissolving 0.2 part by weight of chitosan (produced by Aldrich Chemical Co., Inc.) in 200 parts by weight of a 2% acetic acid aqueous solution were added 2.4 parts by weight of 2-amino-2-hydroxymethyl-1,3-propanediol (common name: Tris), 3.0 parts by weight of calcium acetate and 2000 parts by weight of pure water, and the resulting mixture was stirred and further mixed with 1N hydrochloric acid to adjust a pH value thereof to 6.0, thereby preparing a 10 mM Tris hydrochloride buffer solution in which chitosan-calcium acetate was dissolved. While stirring the thus obtained buffer solution, the dispersion prepared in the dispersion step was sprayed thereto using a sprayer (nozzle diameter: 0.1 mm), thereby obtaining a hydrogel of magnetic composite particles.

<Post-Treatment Step>

The resulting hydrogel was washed with water and then dried in vacuum, and passed through a sieve having a mesh size of 25 μm and a sieve having a mesh size of 100 μm to remove a fine powder and coarse particles therefrom, thereby obtaining the magnetic composite particles.

The thus obtained magnetic composite particles had an average particle diameter of 32 μm, a bulk density of 2.0 g/cm$^3$, a specific gravity of 3.5 g/cm$^3$, a saturation magnetization of 83 Am/kg, an electrical resistivity of $1.2\times10^7$ Ωcm and a BET specific surface area of 0.8-eye m$^2$/g. As a result of a fluorescent X-ray measurement, it was confirmed that the metal component other than magnetite in the magnetic composite particles was calcium, and the content of calcium in the magnetic composite particles was 0.4% by weight.

The thus obtained magnetic composite particles were subjected to compositional analysis as follows. That is, the magnetic composite particles were sampled in an amount of 1.00 part by weight and added into 100 parts by weight of a 1N sodium hydroxide aqueous solution, followed by heating and stirring the resulting mixture. Further, the mixture was filtered to thereby recover soluble components therefrom. The remaining solid components (in the alkali washing solution) were added to 100 parts by weight of a 2% acetic acid aqueous solution, followed by heating and stirring the resulting mixture. Further, the mixture was filtered to thereby recover soluble components therefrom. Then, the remaining insoluble components (in the acid washing solution) were present in an amount of 0.96 part by weight. As a result of subjecting the insoluble components to X-ray diffraction analysis, the insoluble components were identified to be magnetite. In addition, the magnetite had a particle diameter of 230 nm.

Next, the alkali washing solution was mixed with 1N hydrochloric acid so that a white precipitate was produced. The thus obtained white precipitate was dried to measure its amount, so that it was confirmed that the amount of the dried precipitate was 0.02 part by weight. As a result of subjecting the white precipitate to measurement of infrared absorption spectrum, the white precipitate was identified to be alginic acid. Similarly, the acid washing solution was mixed with 1N sodium hydroxide so that a white precipitate was produced. The thus obtained white precipitate was dried to measure its amount, so that it was confirmed that the amount of the dried precipitate was 0.02 part by weight. As a result of subjecting the white precipitate to measurement of infrared absorption spectrum, the white precipitate was identified to be chitosan. Further, it was confirmed that the content of the magnetic fine particles in the magnetic composite particles was 96% by weight.

Example 2-7 to Example 2-10

The same procedure as defined in Example 2-6 was conducted except that the kind and amount of the hydrophobic magnetic fine particles, the amount of the bio-based polymer, the sprayer used, and the nozzle diameter of the sprayer, were changed variously, thereby obtaining magnetic composite particles.

Comparative Example 2-1

Chitosan-Based Magnetic Composite Particles

It was attempted to prepare magnetic composite particles in the same manner as defined in Example 2-6 except that no sodium alginate was added in the dispersion step. As a result, it was confirmed that the obtained magnetic composite particles had a small particle diameter, a high bulk density, a poor fluidity and a less durability.

Comparative Example 2-2

Alginic Acid-Based Magnetic Composite Particles

The same procedure as defined in Example 2-6 was conducted except that no chitosan was added in the granulation step, thereby obtaining magnetic composite particles. However, it was confirmed that the obtained particles had a very low strength and therefore unsuitable for practical use.

Comparative Example 2-3

Polyallylamine-Alginic Acid-Based Magnetic Composite Particles

The same procedure as defined in Example 2-6 was conducted except that polyallylamine (weight-average molecular weight: 8,000) was used in place of chitosan in the granulation step, thereby obtaining magnetic composite particles. As a result, it was confirmed that the obtained magnetic composite particles had an average particle diameter of 35 μm. However, since no environmental burden was taken into consideration owing to use of the petroleum-derived polymer, the resulting particles might be unsafe to human bodies.

The production conditions of the obtained magnetic composite particles are shown in Table 6, and various properties of the magnetic composite particles are shown in Table 7.

TABLE 6

| Magnetic composite particles Kind | Magnetic fine particles Kind | Particle diameter (nm) | Content (%) | Polymer Kind |
|---|---|---|---|---|
| Example 2-1 | Spherical magnetite | 230 | 82 | Chitin |
| Example 2-2 | Spherical magnetite | 230 | 67 | Chitin |
| Example 2-3 | Hexahedral magnetite | 180 | 97 | Chitin |
| Example 2-4 | Octahedral magnetite | 230 | 80 | Chitin |
| Example 2-5 | Spherical magnetite | 180 | 85 | Chitin |
| Example 2-6 | Spherical magnetite | 230 | 96 | Chitosan-alginic acid |
| Example 2-7 | Hexahedral magnetite | 180 | 82 | Chitosan-alginic acid |
| Example 2-8 | Octahedral magnetite | 230 | 67 | Chitosan-alginic acid |
| Example 2-9 | Octahedral magnetite | 230 | 91 | Chitosan-alginic acid |
| Example 2-10 | Spherical magnetite | 230 | 82 | Chitosan-alginic acid |
| Comp. Example 2-1 | Spherical magnetite | 230 | 98 | Chitosan |
| Comp. Example 2-2 | Spherical magnetite | 230 | 98 | Alginic acid |
| Comp. Example 2-3 | Spherical magnetite | 230 | 96 | Polyallylamine-alginic acid |

TABLE 7

| Magnetic composite particles Kind | Properties of magnetic composite particles: Average particle diameter (μm) | Content of magnetic fine particles (%) | Bulk density ($gcm^{-3}$) | Specific gravity ($gcm^{-3}$) |
|---|---|---|---|---|
| Example 2-1 | 32 | 82 | 1.9 | 3.2 |
| Example 2-2 | 45 | 67 | 1.7 | 3.0 |
| Example 2-3 | 47 | 97 | 2.5 | 3.4 |
| Example 2-4 | 18 | 80 | 1.6 | 2.7 |
| Example 2-5 | 35 | 85 | 2.0 | 3.4 |
| Example 2-6 | 32 | 96 | 2.0 | 3.5 |
| Example 2-7 | 42 | 82 | 2.0 | 3.1 |
| Example 2-8 | 62 | 67 | 1.6 | 2.8 |
| Example 2-9 | 52 | 91 | 2.4 | 3.5 |
| Example 2-10 | 36 | 82 | 1.9 | 3.1 |
| Comp. Example 2-1 | 8 | 98 | 4.0 | 2.5 |
| Comp. Example 2-2 | 28 | 98 | 2.0 | 3.2 |
| Comp. Example 2-3 | 35 | 85 | 2.5 | 3.5 |

| Magnetic composite particles Kind | Properties of magnetic composite particles: Saturation magnetization ($Am^2kg^{-1}$) | Electrical resistivity (·cm) | BET ($m^2g^{-1}$) |
|---|---|---|---|
| Example 2-1 | 70 | $3.8 \times 10^8$ | 0.3 |
| Example 2-2 | 58 | $5.1 \times 10^8$ | 0.3 |
| Example 2-3 | 83 | $9.5 \times 10^7$ | 0.2 |
| Example 2-4 | 54 | $2.1 \times 10^9$ | 0.5 |
| Example 2-5 | 72 | $4.8 \times 10^8$ | 0.3 |
| Example 2-6 | 83 | $1.2 \times 10^7$ | 0.8 |
| Example 2-7 | 70 | $3.0 \times 10^8$ | 0.2 |
| Example 2-8 | 58 | $8.8 \times 10^8$ | 0.3 |
| Example 2-9 | 79 | $9.8 \times 10^7$ | 0.1 |

TABLE 7-continued

| | | | |
|---|---|---|---|
| Example 2-10 | 70 | $3.0 \times 10^8$ | 0.3 |
| Comp. Example 2-1 | 83 | $1.2 \times 10^7$ | 1.2 |
| Comp. Example 2-2 | 83 | $1.9 \times 10^7$ | 0.8 |
| Comp. Example 2-3 | 75 | $1.3 \times 10^9$ | 0.1 |

| | Properties of magnetic composite particles | | |
|---|---|---|---|
| Magnetic composite particles Kind | Kind of polymer | Content of polymer (%) | Content of alkali earth metal (%) |
| Example 2-1 | Chitin | 17 | 0.5 |
| Example 2-2 | Chitin | 32 | 0.3 |
| Example 2-3 | Chitin | 3 | 0.6 |
| Example 2-4 | Chitin | 19 | 0.5 |
| Example 2-5 | Chitin | 14 | 0.4 |
| Example 2-6 | Chitosan-alginic acid | 4 | 0.4 |
| Example 2-7 | Chitosan-alginic acid | 18 | 0.7 |
| Example 2-8 | Chitosan-alginic acid | 32 | 0.6 |
| Example 2-9 | Chitosan-alginic acid | 8 | 0.5 |
| Example 2-10 | Chitosan-alginic acid | 18 | 0.4 |
| Comp. Example 2-1 | Chitosan | 2 | 0.0 |
| Comp. Example 2-2 | Alginic acid | 2 | 0.6 |
| Comp. Example 2-3 | Polyallyamine-alginic acid | 4 | 0.4 |

| | Properties of magnetic composite particles | | | |
|---|---|---|---|---|
| Magnetic composite particles Kind | Fluidity | Durability | Effect of reducing environmental burden | Safety to human bodies |
| Example 2-1 | ○ | ○ | ○ | ○ |
| Example 2-2 | ○ | ○ | ○ | ○ |
| Example 2-3 | ○ | ○ | ○ | ○ |
| Example 2-4 | ○ | ○ | ○ | ○ |
| Example 2-5 | ○ | ○ | ○ | ○ |
| Example 2-6 | ○ | ○ | ○ | ○ |
| Example 2-7 | ○ | ○ | ○ | ○ |
| Example 2-8 | ○ | ○ | ○ | ○ |
| Example 2-9 | ○ | ○ | ○ | ○ |
| Example 2-10 | ○ | ○ | ○ | ○ |
| Comp. Example 2-1 | x | x | ○ | ○ |
| Comp. Example 2-2 | ○ | x | ○ | ○ |
| Comp. Example 2-3 | ○ | ○ | x | x |

As shown in Tables 6 and 7, the magnetic composite particles according to the present invention in which the bio-based polymer was used were effective for reduction of environmental burden such as saving of underground sources and prevention of global warming, were safe to human bodies, and exhibited a high durability. In addition, the magnetic composite particles according to the present invention had a small bulk density and an excellent fluidity, and therefore were apparently very excellent in properties when used as a raw material for magnetic carriers, a magnetic carrier or a developer. Further, the magnetic composite particles according to the present invention were produced through the granulation step and therefore suitable for attaining a high image quality.

Magnetic Carrier

Example 2-11 to Example 2-20

The magnetic composite particles and a toner were blended with each other at the following mixing ratio, and the resulting mixture was shaken for a predetermined period of time using a tumbler-shaker-mixer "T2F" manufactured by Shinmaru Enterprise Corp., to measure a charge amount on the toner and thereby evaluate a performance of the magnetic composite particles as a magnetic carrier.

| | |
|---|---|
| Magnetic carrier (magnetic composite particles) | 92 parts by weight |
| Toner | 8 parts by weight |

The charge amount of the toner was measured using a blow-off charge amount measuring device "TB-200" manufactured by Kyocera Chemical Corp. The rate of change in the charge amount was expressed by the percentage calculated by multiplying the value obtained by dividing a difference between an initial charge amount after shaken for 1 min and a charge amount after shaken for 2 hr by the initial charge amount, by 100. The results are shown in Table 8.

TABLE 8

| Magnetic carrier Kind | Magnetic composite particles Kind | Toner Kind | Properties Rate of change in charge amount (%) |
|---|---|---|---|
| Example 2-11 | Example 2-1 | Cyan toner (n) | 5 |
| Example 2-12 | Example 2-2 | Cyan toner (n) | 5 |
| Example 2-13 | Example 2-3 | Cyan toner (n) | 6 |
| Example 2-14 | Example 2-4 | Cyan toner (n) | 9 |
| Example 2-15 | Example 2-5 | Cyan toner (n) | 10 |
| Example 2-16 | Example 2-6 | Cyan toner (n) | 8 |
| Example 2-17 | Example 2-7 | Cyan toner (n) | 9 |
| Example 2-18 | Example 2-8 | Cyan toner (n) | 8 |
| Example 2-19 | Example 2-9 | Cyan toner (p) | 8 |
| Example 2-20 | Example 2-10 | Cyan toner (p) | 5 |
| Comp. Example 2-4 | Comp. Example 2-1 | Cyan toner (n) | 100 |
| Comp. Example 2-5 | Comp. Example 2-2 | Cyan toner (p) | Not measurable |
| Comp. Example 2-6 | Comp. Example 2-3 | Cyan toner (p) | 8 |

Magnetic Carrier

Formation of Surface-Coating Layer

Example 2-21

One hundred parts by weight of the magnetic composite particles (Example 2-1) were charged into a mixing stirrer "5XDML-03-r" manufactured by Dalton Corp., and stirred therein at 40° C. A solution prepared by dissolving 1 part by weight of ethyl cellulose (Mw=30,000) in 20 parts by weight of ethyl acetate was added to the magnetic composite particles, and the resulting mixture was stirred at 40° C. for 2 hr under a nitrogen gas flow (a whole amount of a vapor of ethyl acetate was collected to recover and reuse the ethyl acetate). Thereafter, the contents of the stirrer were heated to 80° C. and stirred for 2 hr. The resulting particles were passed through a sieve having a mesh size of 25 μm and a sieve having a mesh size of 100 μm to remove a fine powder and coarse particles therefrom, thereby obtaining a magnetic carrier according to the present invention (formation of a surface-coating layer). As a result, it was confirmed that the thus obtained magnetic carrier had an electrical resistivity of $5.1\times10^{10}$·cm. Further, the magnetic carrier was mixed with the toner as described previously to measure a charge amount of the toner. As a result, it was confirmed that the rate of change in charge amount of the toner was 5%.

Example 2-22

The same procedure as defined in Example 21 was conducted except that a dispersion prepared by adding 0.1 part by weight of carbon black (average particle diameter: 20 nm) to a solution prepared by dissolving 1 part by weight ethyl cellulose in 20 parts by weight of ethyl acetate and then fully dispersing the resulting mixture using an ultrasonic homogenizer was used, thereby obtaining a magnetic carrier according to the present invention (formation of a surface-coating layer). As a result, it was confirmed that the thus obtained magnetic carrier had an electrical resistivity of $3.8\times10^{11}$ Ωcm, and the rate of change in charge amount of the toner was 7%.

Example 2-23 to Example 2-31

The same procedure as defined in Examples 2-21 and 2-22 was conducted except that the kind and amount of the magnetic carrier (magnetic composite particles), the kind and amount of the resin, the kind and amount of the inorganic fine particles, and the kind and amount of the organic solvent, were changed variously, thereby obtaining magnetic carriers (formation of a surface-coating layer). The results are shown in Table 9.

TABLE 9

| Magnetic carrier Kind | Magnetic composite particles Kind | Coating layer: Coupling agent and resin | Coating layer: Molecular weight | Coating layer: Coating amount (%) |
|---|---|---|---|---|
| Example 2-21 | Example 2-1 | Ethyl cellulose | 30,000 | 1.0 |
| Example 2-22 | Example 2-1 | Ethyl cellulose | 30,000 | 1.0 |
| Example 2-23 | Example 2-4 | L-polylactic acid | 86,000 | 1.0 |
| Example 2-24 | Example 2-5 | L-polylactic acid | 86,000 | 1.0 |
| Example 2-25 | Example 2-6 | Chitosan | 50,000 | 1.8 |
| Example 2-26 | Example 2-7 | Alginic acid | 50,000 | 1.5 |
| Example 2-27 | Example 2-8 | Poly(methyl methacrylate) | 40,000 | 0.5 |
| Example 2-28 | Example 2-9 | Poly(styrene-maleic acid) | 80,000 | 1.2 |
| Example 2-29 | Example 2-9 | Acryl-modified silicone | Not measurable due to curable resin | 0.8 |
| Example 2-30 | Example 2-10 | Aminopropyl triethoxysilane + methyl straight silicone | Not measurable due to curable resin | 1.0 |
| Example 2-31 | Example 2-10 | Aminopropyl triethoxysilane + methyl phenyl silicone + poly(styrene-maleic acid) | Not measurable due to curable resin | 2.2 |

TABLE 9-continued

| Magnetic carrier Kind | Coating layer: Inorganic fine particles | Coating layer: Amount added (%) | Coating layer: Electrical resistivity (·cm) | Toner: Kind | Toner: Rate of change in charge amount (%) |
|---|---|---|---|---|---|
| Example 2-21 | — | — | $5.1\times10^{10}$ | Cyan toner (p) | 5 |
| Example 2-22 | Carbon black | 0.1 | $3.8\times10^{11}$ | Cyan toner (p) | 7 |
| Example 2-23 | — | — | $1.6\times10^{13}$ | Cyan toner (p) | 2 |
| Example 2-24 | Carbon black | 0.1 | $5.2\times10^{11}$ | Cyan toner (p) | 5 |
| Example 2-25 | Carbon black | 0.3 | $2.1\times10^{11}$ | Cyan toner (n) | 9 |
| Example 2-26 | — | — | $7.3\times10^{10}$ | Cyan toner (p) | 4 |
| Example 2-27 | — | — | $1.0\times10^{11}$ | Cyan toner (n) | 12 |
| Example 2-28 | — | — | $2.3\times10^{12}$ | Cyan toner (p) | 4 |
| Example 2-29 | Alumina | 0.05 | $8.0\times10^{13}$ | Cyan toner (n) | 10 |
| Example 2-30 | Titanium oxide | 0.1 | $1.0\times10^{14}$ | Cyan toner (p) | 5 |
| Example 2-31 | Silica | 0.2 | $3.6\times10^{15}$ | Cyan toner (p) | 5 |

As shown in Tables 8 and 9, the magnetic carriers according to the present invention apparently exhibited a high durability. Also, it was apparently recognized that the magnetic carriers in which the bio-based polymer was used were effective for reduction of environmental burden such as saving of underground sources and prevention of global warming, and were safe to human bodies.

[Developer]

The magnetic carrier and a toner were blended with each other at the following mixing ratio, and the resulting mixture was mixed using a universal ball mill "UB-32" manufactured by Yamato Scientific Co., Ltd., to obtain a developer.

| | |
|---|---|
| Magnetic composite particles | 92 parts by weight |
| Toner | 8 parts by weight |

The thus obtained developer and the toner were subjected to a printing test in which characters and solid images were printed using a printer "LS-05016N" manufactured by Kyocera Mita Corp. The image clarity was evaluated according to the following ratings: ○: beautiful image quality was attained on the first printed image; and x: thin spots of the characters and unevenness of the solid image were observed even on the first printed image. In addition, the image durability was evaluated according to the following ratings: ○: 1000 sheets were printed without deterioration in image quality; Δ: 500 sheets were printed without deterioration in image quality; and x: deterioration in image quality occurred when less than 500 sheets were printed. The results are shown in Table 10.

TABLE 10

| Developer Kind | Magnetic carrier Kind | Toner Kind | Properties of developer: Image clarity | Properties of developer: Image durability |
|---|---|---|---|---|
| Example 2-32 | Example 2-11 | Cyan toner (n) | ○ | ○ |
| Example 2-33 | Example 2-12 | Cyan toner (n) | ○ | Δ |
| Example 2-34 | Example 2-13 | Cyan toner (n) | ○ | ○ |
| Example 2-35 | Example 2-14 | Cyan toner (n) | ○ | ○ |
| Example 2-36 | Example 2-15 | Cyan toner (n) | ○ | ○ |
| Example 2-37 | Example 2-16 | Cyan toner (n) | ○ | Δ |
| Example 2-38 | Example 2-17 | Cyan toner (n) | ○ | Δ |
| Example 2-39 | Example 2-18 | Cyan toner (n) | ○ | Δ |
| Example 2-40 | Example 2-19 | Cyan toner (p) | ○ | Δ |
| Example 2-41 | Example 2-20 | Cyan toner (p) | ○ | ○ |
| Example 2-42 | Example 2-21 | Cyan toner (p) | Δ | ○ |
| Example 2-43 | Example 2-22 | Cyan toner (p) | Δ | ○ |
| Example 2-44 | Example 2-23 | Cyan toner (p) | ○ | ○ |
| Example 2-45 | Example 2-24 | Cyan toner (p) | ○ | ○ |
| Example 2-46 | Example 2-25 | Cyan toner (n) | ○ | ○ |
| Example 2-47 | Example 2-26 | Cyan toner (p) | ○ | ○ |
| Example 2-48 | Example 2-27 | Cyan toner (n) | ○ | ○ |
| Example 2-49 | Example 2-28 | Cyan toner (p) | ○ | Δ |
| Example 2-50 | Example 2-29 | Cyan toner (n) | ○ | Δ |
| Example 2-51 | Example 2-30 | Cyan toner (p) | ○ | ○ |
| Example 2-52 | Example 2-31 | Cyan toner (p) | ○ | ○ |
| Comp. Example 2-4 | Comp. Example 2-1 | Cyan toner (n) | x | x |
| Comp. Example 2-5 | Comp. Example 2-2 | Cyan toner (p) | x | x |
| Comp. Example 2-6 | Comp. Example 2-3 | Cyan toner (p) | ○ | ○ |

As shown in Table 10, the developers according to the present invention apparently exhibited a high image clarity and a high image durability. Also, it was apparently recognized that the developers according to the present invention in which the bio-based polymer was used were effective for reduction of environmental burden such as saving of underground sources and prevention of global warming, and were safe to human bodies.

The following various Examples, etc., relate to the magnetic composite particles (magnetic carrier) according to Invention 3 or 4.

Toner Production Example 3-1

| | |
|---|---|
| Polyester resin | 100 parts by weight |
| Copper phthalocyanine | 5 parts by weight |
| Antistatic agent (quaternary ammonium salt) | 4 parts by weight |
| Low-molecular weight polyolefin | 3 parts by weight |

The above materials were fully pre-mixed with each other using a Henschel mixer, and then melt-kneaded in a twin-screw extrusion kneader. After being cooled, the obtained kneaded material was pulverized using a hammer mill and subjected to classification to thereby obtain positive-charged blue particles having a weight-average particle diameter of 7 μm.

Next, 100 parts by weight of the resulting positive-charged blue particles and 1 part by weight of hydrophobic silica were mixed with each other using a Henschel mixer, thereby obtaining a positive-charged cyan toner (a').

Toner Production Example 3-2

| | |
|---|---|
| Polyester resin | 100 parts by weight |
| Copper phthalocyanine | 5 parts by weight |
| Antistatic agent (zinc di-tert-butyl salicylate compound) | 3 parts by weight |
| Wax | 9 parts by weight |

The above materials were fully pre-mixed with each other using a Henschel mixer, and then melt-kneaded in a twin-screw extrusion kneader. After being cooled, the obtained kneaded material was pulverized using a hammer mill and subjected to classification to thereby obtain negative-charged blue particles having a weight-average particle diameter of 7 μm.

Next, 100 parts by weight of the resulting negative-charged blue particles and 1 part by weight of hydrophobic silica were mixed with each other using a Henschel mixer, thereby obtaining a negative-charged cyan toner (b').

Carrier Core Production Example 3-1

Binder-Type Carrier Core

A flask was charged with 100 parts by weight of spherical magnetite fine particles (having an average particle diameter of 230 nm), and the inside atmosphere of the flask was replaced with nitrogen. After fully stirring the magnetite fine particles, 1.5 parts by weight of stearic acid were added to the flask, and the contents of the flask were heated to 80° C., and intimately stirred in a nitrogen atmosphere for 30 min, thereby obtaining stearyl group-coated hydrophobic magnetic fine particles. The thus obtained hydrophobic magnetic fine particles in an amount of 10 parts by weight were mixed with 2 parts by weight of L-polylactic acid (Mw=86,000) and 38 parts by weight of 1,2-dichloroethane, and the resulting mixture was fully dispersed using an ultrasonic homogenizer. The resulting dispersion was charged into 1000 parts by weight of water and suspended therein using a homomixer at 4,000 rpm, thereby obtaining a suspension comprising droplets. The resulting suspension was stirred using an agitation blade while bubbling with a nitrogen gas, and heated to 90° C. to transpire 1,2-dichloroethane in the droplets. The resulting slurry was washed with water and then dried in vacuum, and further classified using an electromagnetic sieve, thereby obtaining a carrier core 3-1 (binder-type carrier core) having an average particle diameter of 34 μm.

Carrier Core Production Example 3-2

Binder-Type Carrier Core

The same procedure as defined in Carrier Core Production Example 3-1 was conducted except that a rotating speed of the suspension in the homomixer was changed from 4,000 rpm to 2,500 rpm, thereby obtaining a carrier core 3-2 (binder-type carrier core) having an average particle diameter of 75 μm.

Carrier Core Production Example 3-3

Ferrite Carrier Core

| | |
|---|---|
| MnO | 39.7 mol % |
| MgO | 9.9 mol % |
| $Fe_2O_3$ | 49.6 mol % |
| SrO | 0.8 mol % |

The above materials were blended with each other, and the resulting mixture was mixed with water, pulverized for 10 hr using a wet ball mill, and mixed and then dried. Thereafter, the mixture was heated at 950° C. for 4 hr and then pulverized for 24 hr using a wet ball mill, followed by granulating and drying the resulting particles. Then, the thus obtained particles were heated at 1270° C. for 6 hr in an atmosphere having an oxygen concentration of 2%, and then subjected to deaggregation and classification, thereby obtaining a carrier core 3-3 (ferrite carrier core) having an average particle diameter of 51 μm.

Carrier Core Production Example 3-4

Ferrite Carrier Core

The same procedure as defined in Carrier Core Production Example 3-3 was conducted except that the pulverization and classification conditions were varied, thereby obtaining a carrier core 3-4 (ferrite carrier core) having an average particle diameter of 108 μm.

Example 3-1

Magnetic Carrier Produced Using Ethyl Cellulose

<Coating Step>

| | |
|---|---|
| Ethyl cellulose (Mw = 100,000) | 1 part by weight |
| Ethanol | 49 parts by weight |

The above materials were stirred together and dissolved to prepare an ethyl cellulose solution 1. Thereafter, 100 parts by weight of the carrier core 3-1 were charged into a universal stirrer, and then the ethyl cellulose solution 1 was charged thereinto, and the contents of the stirrer were stirred at 60° C. for 2 hr.

<Curing Step>

The particles obtained in the coating step were charged into a rotary furnace and dried therein at 80° C. for 2 hr in a nitrogen atmosphere.

<Post-Treatment Step>

The resulting particles were passed through a sieve having a mesh size of 25 μm and a sieve having a mesh size of 100 μm to remove a fine powder and coarse particles therefrom, thereby obtaining a magnetic carrier according to the present invention. The thus obtained magnetic carrier had an average particle diameter of 36 μm, a bulk density of 1.9 g/cm$^3$, a specific gravity of 3.2 g/cm$^3$, a saturation magnetization of 70 Am/kg, an electrical resistivity of $3.8\times10^{12}$ Ωcm and a BET specific surface area of 0.3 m$^2$/g.

The thus obtained magnetic carrier was subjected to compositional analysis as follows. That is, the magnetic carrier was sampled in an amount of 1.000 part by weight and subjected to Soxhlet extraction using ethanol to extract soluble components of the magnetic carrier in ethanol. The remaining insoluble components were present in an amount of 0.990 part by weight, and had a particle diameter of 35 μm.

Next, the ethanol extract solution was mixed with pure water so that a white precipitate was produced. The thus obtained white precipitate was dried to measure its amount, so that it was confirmed that the amount of the dried precipitate was 0.010 part by weight. As a result of subjecting the white precipitate to measurement of infrared absorption spectrum, the white precipitate was identified to be ethyl cellulose. As a result of the measurement of a weight-average molecular weight of the white precipitate, it was confirmed that the ethyl cellulose had a weight-average molecular weight of 100,000. Further, it was confirmed that the content of the bio-based polymer (ethyl cellulose) in the magnetic carrier was 1.0% by weight.

Example 3-2 to Example 3-12

The same procedure as defined in Example 3-1 was conducted except that the kind and amount of the carrier core, the kind and amount of the bio-based polymer, and the kind and amount of the solvent, were changed variously, thereby obtaining magnetic carriers.

Comparative Example 3-1

In which a Petroleum-Derived Polymer was Used

The same procedure as defined in Example 3-1 was conducted except that a styrene-methyl methacrylate copolymer (weight-average molecular weight: 80,000) was used in place of ethyl cellulose, thereby obtaining a magnetic carrier. As a result, it was confirmed that the resulting magnetic carrier had an average particle diameter of 37 μm. However, since no environmental burden was taken into consideration owing to use of the petroleum-derived polymer, the magnetic carrier was less effective for reduction of environmental burden such as saving of underground sources and prevention of global warming.

Comparative Example 3-2

In which the Magnetic Carrier Having a Large Particle Diameter was Used

The same procedure as defined in Example 3-1 was conducted except that the carrier core 4 was used in place of the carrier core 1, thereby obtaining a magnetic carrier. As a result, it was confirmed that the resulting magnetic carrier had an average particle diameter of 110 μm, and therefore failed to exhibit a high image clarity and a high image durability due to such a large particle diameter, and further was unsuitable for electrophotographic development.

Comparative Example 3-3

In which the Bio-Based Polymer was Used in an Excessively Large Amount

The same procedure as defined in Example 3-1 was conducted except that the amount of ethyl cellulose used was changed from 1 part by weight to 3.5 parts by weight, thereby obtaining a magnetic carrier. As a result, it was confirmed that the resulting magnetic carrier had an average particle diameter of 38 μm. Further, the resulting magnetic carrier was a complete insulator owing to the large amount of the polymer used, and therefore failed to serve for printing operation using a printing machine.

The production conditions of the thus obtained magnetic carriers are shown in Table 11, and various properties of the magnetic carriers are shown in Table 12.

TABLE 11

| Magnetic carrier Kind | Carrier core Kind | Polymer Kind | Molecular weight | Coating amount (%) |
|---|---|---|---|---|
| Example 3-1 | Carrier core 3-1 | Ethyl cellulose | 100,000 | 1.0 |
| Example 3-2 | Carrier core 3-1 | L-polylactic acid | 5,000 | 1.8 |
| Example 3-3 | Carrier core 3-2 | L-polylactic acid | 300,000 | 0.5 |
| Example 3-4 | Carrier core 3-2 | L-polylactic acid | 86,000 | 1.0 |
| Example 3-5 | Carrier core 3-3 | Polyglycolic acid | 30,000 | 0.3 |
| Example 3-6 | Carrier core 3-1 | Poly(tetramethylene terephthalate) | 40,000 | 1.0 |
| Example 3-7 | Carrier core 3-1 | Poly-α-methylene-γ-butyrolactone | 40,000 | 1.5 |
| Example 3-8 | Carrier core 3-2 | D- and L-polylactic acid copolymer | 55,000 | 1.2 |
| Example 3-9 | Carrier core 3-2 | L-polylactic acid-polyglycolic acid copolymer | 20,000 | 0.8 |
| Example 3-10 | Carrier core 3-3 | L-polylactic acid + D-polylactic acid | 86000 + 30,000 | 1.3 |
| Example 3-11 | Carrier core 3-3 | D- and L-polylactic acid copolymer + poly(tetramethylene terephthalate) | 55,000 + 40,000 | 2.0 |
| Example 3-12 | Carrier core 3-3 | L-polylactic acid + poly(tetramethylene terephthalate) + poly-α-methylene-γ-butyrolactone | 86,000 + 40,000 + 40,000 | 2.0 |
| Comp. Example 3-1 | Carrier core 3-1 | Styrene-MMA copolymer | 50,000 | 1.5 |
| Comp. Example 3-2 | Carrier core 3-4 | Ethyl cellulose | 100,000 | 0.5 |
| Comp. Example 3-3 | Carrier core 3-1 | Ethyl cellulose | 100,000 | 3.5 |

TABLE 12

| Magnetic carrier Kind | Properties of magnetic carrier: Average particle diameter (μm) | Coating amount of polymer (%) | Bulk density ($gcm^{-3}$) | Specific gravity ($gcm^{-3}$) |
|---|---|---|---|---|
| Example 3-1 | 36 | 1.0 | 1.9 | 3.5 |
| Example 3-2 | 38 | 1.8 | 1.9 | 3.5 |
| Example 3-3 | 75 | 0.5 | 1.6 | 3.3 |
| Example 3-4 | 77 | 1.0 | 1.6 | 3.3 |
| Example 3-5 | 52 | 0.3 | 2.6 | 4.6 |
| Example 3-6 | 36 | 1.0 | 1.9 | 3.5 |
| Example 3-7 | 36 | 1.5 | 1.9 | 3.5 |
| Example 3-8 | 76 | 1.2 | 1.6 | 3.3 |
| Example 3-9 | 74 | 0.8 | 1.6 | 3.3 |
| Example 3-10 | 52 | 1.3 | 2.6 | 4.6 |
| Example 3-11 | 51 | 2.0 | 2.6 | 4.6 |
| Example 3-12 | 55 | 2.0 | 2.6 | 4.7 |
| Comp. Example 3-1 | 37 | 1.5 | 1.9 | 3.5 |
| Comp. Example 3-2 | 110 | 0.5 | 2.8 | 4.7 |
| Comp. Example 3-3 | 38 | 3.5 | 1.9 | 3.5 |

| Magnetic carrier Kind | Properties of magnetic carrier: Saturation magnetization ($Am^2kg^{-1}$) | Electrical resistivity (·cm) | BET ($m^2g^{-1}$) |
|---|---|---|---|
| Example 3-1 | 75 | $3.8 \times 10^{12}$ | 0.3 |
| Example 3-2 | 75 | $5.2 \times 10^{15}$ | 0.3 |
| Example 3-3 | 74 | $8.8 \times 10^{10}$ | 0.1 |
| Example 3-4 | 74 | $4.5 \times 10^{13}$ | 0.1 |
| Example 3-5 | 91 | $7.9 \times 10^{12}$ | 1.0 |
| Example 3-6 | 74 | $2.6 \times 10^{10}$ | 0.2 |
| Example 3-7 | 74 | $5.7 \times 10^{14}$ | 0.3 |
| Example 3-8 | 74 | $1.3 \times 10^{13}$ | 0.1 |
| Example 3-9 | 74 | $5.1 \times 10^{12}$ | 0.1 |
| Example 3-10 | 91 | $3.9 \times 10^{14}$ | 1.0 |
| Example 3-11 | 91 | $8.0 \times 10^{15}$ | 1.1 |
| Example 3-12 | 91 | $5.6 \times 10^{15}$ | 0.9 |
| Comp. Example 3-1 | 75 | $3.9 \times 10^{13}$ | 0.3 |
| Comp. Example 3-2 | 81 | $3.9 \times 10^{13}$ | 0.5 |
| Comp. Example 3-3 | 75 | $4.0 \times 10^{16}$ | 0.5 |

| Magnetic carrier Kind | Properties of magnetic carrier: Kind of polymer | Glass transition point of polymer (° C.) | Molecular weight of polymer |
|---|---|---|---|
| Example 3-1 | Ethyl cellulose | 43 | 100,000 |
| Example 3-2 | L-polylactic acid | 56 | 5,000 |
| Example 3-3 | L-polylactic acid | 56 | 300,000 |
| Example 3-4 | L-polylactic acid | 56 | 86,000 |
| Example 3-5 | Polyglycolic acid | 45 | 30,000 |
| Example 3-6 | Poly(trimethylene terephthalate) | 51 | 40,000 |
| Example 3-7 | Poly-α-methylene-γ-butyrolactone | >180 | 40,000 |
| Example 3-8 | D- and L-polylactic acid copolymer | 56 | 55,000 |
| Example 3-9 | L-polylactic acid-polyglycolic acid copolymer | 47 | 20,000 |
| Example 3-10 | L-polylactic acid + D-polylactic acid | 57 | 86,000 + 30,000 |
| Example 3-11 | D- and L-polylactic acid copolymer + poly(trimethylene terephthalate) | 51 | 55,000 + 40,000 |
| Example 3-12 | L-polylactic acid + poly(trimethylene terephthalate) + poly-α-methylene-γ-butyrolactone | 51 | 86,000 + 40,000 + 40,000 |

TABLE 12-continued

| | | | |
|---|---|---|---|
| Comp. Example 3-1 | Styrene-MMA copolymer | 80 | 50,000 |
| Comp. Example 3-2 | Ethyl cellulose | 43 | 100,000 |
| Comp. Example 3-3 | Ethyl cellulose | 43 | 100,000 |

| Magnetic carrier Kind | Properties of magnetic carrier | | | |
|---|---|---|---|---|
| | Fluidity | Durability | Effect of reducing environmental burden | Safety to human bodies |
| Example 3-1 | ○ | ○ | ○ | ○ |
| Example 3-2 | ○ | ○ | ○ | ○ |
| Example 3-3 | ○ | ○ | ○ | ○ |
| Example 3-4 | ○ | ○ | ○ | ○ |
| Example 3-5 | ○ | ○ | ○ | ○ |
| Example 3-6 | ○ | ○ | ○ | ○ |
| Example 3-7 | ○ | ○ | ○ | ○ |
| Example 3-8 | ○ | ○ | ○ | ○ |
| Example 3-9 | ○ | ○ | ○ | ○ |
| Example 3-10 | ○ | ○ | ○ | ○ |
| Example 3-11 | ○ | ○ | ○ | ○ |
| Example 3-12 | ○ | ○ | ○ | ○ |
| Comp. Example 3-1 | ○ | ○ | x | x |
| Comp. Example 3-2 | ○ | ○ | ○ | ○ |
| Comp. Example 3-3 | x | ○ | ○ | ○ |

As shown in Tables 11 and 12, the magnetic carriers according to the present invention apparently exhibited various excellent properties. Also, it was apparently recognized that the magnetic carriers according to the present invention in which the bio-based polymer was used were effective for reduction of environmental burden such as saving of underground sources and prevention of global warming, and were safe to human bodies.

[Developer]

The magnetic carrier and a toner were blended with each other at the following mixing ratio, and the resulting mixture was mixed using a universal ball mill "UB-32" manufactured by Yamato Scientific Co., Ltd., to obtain a developer.

| | |
|---|---|
| Magnetic carrier | 92 parts by weight |
| Toner | 8 parts by weight |

<Charge Properties>

The thus obtained developer was shaken using a tumbler-shaker-mixer "T2F" manufactured by Shinmaru Enterprise Corp. The charge amount of the toner was measured using a blow-off charge amount measuring device "TB-200" manufactured by Kyocera Chemical Corp. The rate of change in the charge amount was expressed by the percentage calculated by multiplying the value obtained by dividing a difference between an initial charge amount and a charge amount after shaken for 2 hr by the initial charge amount, by 100.

<Printing Properties>

The thus obtained developer was further subjected to a printing test in which characters and solid images were printed using a printer "LS-05016N" manufactured by Kyocera Mita Corp. The image clarity was evaluated according to the following ratings: ○: beautiful image quality was attained on the first printed image; Δ: thin spots of the characters occurred on the first printed image, but no unevenness of the solid image was observed; and x: thin spots of the characters and unevenness of the solid image were observed even on the first printed image. In addition, the image durability was evaluated according to the following ratings: ○: 1000 sheets were printed without deterioration in image quality; Δ: 500 sheets were printed without deterioration in image quality; and x: deterioration in image quality occurred when less than 500 sheets were printed. The results are shown in Table 13.

TABLE 13

| Developer Kind | Magnetic carrier Kind | Toner Kind |
|---|---|---|
| Example 3-13 | Example 3-1 | Cyan toner (a') |
| Example 3-14 | Example 3-2 | Cyan toner (a') |
| Example 3-15 | Example 3-3 | Cyan toner (a') |
| Example 3-16 | Example 3-4 | Cyan toner (a') |
| Example 3-17 | Example 3-5 | Cyan toner (a') |
| Example 3-18 | Example 3-6 | Cyan toner (a') |
| Example 3-19 | Example 3-7 | Cyan toner (b') |
| Example 3-20 | Example 3-8 | Cyan toner (a') |
| Example 3-21 | Example 3-9 | Cyan toner (a') |
| Example 3-22 | Example 3-10 | Cyan toner (a') |
| Example 3-23 | Example 3-11 | Cyan toner (a') |
| Example 3-24 | Example 3-12 | Cyan toner (a') |
| Comp. Example 3-4 | Comp. Example 3-1 | Cyan toner (b') |
| Comp. Example 3-5 | Comp. Example 3-2 | Cyan toner (a') |
| Comp. Example 3-6 | Comp. Example 3-3 | Cyan toner (a') |

| Developer Kind | Charge properties Rate of change in charge amount (%) | Printing properties | |
|---|---|---|---|
| | | Image clarity | Image durability |
| Example 3-13 | 5 | ○ | ○ |
| Example 3-14 | 5 | ○ | ○ |
| Example 3-15 | 6 | Δ | ○ |
| Example 3-16 | 9 | Δ | ○ |
| Example 3-17 | 10 | ○ | ○ |
| Example 3-18 | 8 | ○ | ○ |
| Example 3-19 | 9 | ○ | ○ |
| Example 3-20 | 8 | Δ | ○ |
| Example 3-21 | 8 | Δ | ○ |
| Example 3-22 | 5 | ○ | ○ |
| Example 3-23 | 8 | ○ | ○ |
| Example 3-24 | 3 | ○ | ○ |
| Comp. Example 3-4 | 5 | ○ | ○ |
| Comp. Example 3-5 | 5 | x | x |
| Comp. Example 3-6 | 13 | x | x |

As shown in Table 13, the developers according to the present invention apparently exhibited excellent charge properties and printing properties. Also, it was apparently recognized that the developers according to the present invention in which the bio-based polymer was used were effective for reduction of environmental burden such as saving of underground sources and prevention of global warming.

INDUSTRIAL APPLICABILITY

The magnetic composite particles according to the present invention comprise a bio-based polymer and magnetic fine particles, are effective for reduction of environmental burden such as saving of underground sources and prevention of global warming, are safe to human bodies, exhibit a high durability, and are capable of forming developed images with a high quality. Thus, the magnetic composite particles are suitable for magnetic carriers and developers.

The magnetic carrier according to the present invention comprises the magnetic composite particles having the above-described properties, and is therefore effective for reduction of environmental burden such as saving of underground sources and prevention of global warming, is safe to human bodies, exhibits a high durability, and is capable of forming developed images with a high quality. Thus, the magnetic carrier is suitable for magnetic carriers and developers.

The developer according to the present invention comprises the magnetic composite particles having the above-described properties or the magnetic carrier, and is therefore effective for reduction of environmental burden such as saving of underground sources and prevention of global warming, is safe to human bodies, exhibits a high durability, and is capable of forming developed images with a high quality. Thus, the developer is suitable for developers.

The invention claimed is:

1. Magnetic composite particles having an average particle diameter of 10 to 100 μm and comprising at least:

magnetic fine particles which are contained in the magnetic composite particles in an amount of 50 to 99.9% by weight, and a bio-based polymer which has a glass transition point of 45° C. or more and selected from the group consisting of: polylactic acid, polyglycolic acid, poly(trimethylene terephthalate), poly-α-methylene-γ-butyrolactone, chitin and a chitosan/alginic acid composite material;

a copolymer comprising a monomer unit derived from polylactic acid, polyglycolic acid, poly(trimethylene terephthalate) and poly-α-methylene-γ-butyrolactone; and a polymer mixture comprising at least one of polylactic acid, polyglycolic acid, poly(trimethylene terephthalate) and poly-α-methylene-γ-butyrolactone: together with chitin and/or a chitosan/alginic acid composite material;

wherein the magnetic composite particles are devoid of resins derived from underground sources.

2. Magnetic composite particles according to claim 1, wherein the content of the magnetic fine particles in the magnetic composite particles is 50 to 99% by weight, and the bio-based polymer is used as a binder for the magnetic fine particles.

3. Magnetic composite particles according to claim 1, wherein the content of the magnetic fine particles in the magnetic composite particles is 97 to 99.9% by weight, and the magnetic fine particles are coated with the bio-based polymer.

4. Magnetic composite particles according to claim 3, further comprising a binder other than the bio-based polymer, wherein the magnetic fine particles cooperate with the binder other than the bio-based polymer to form a core, and the core is coated with the bio-based polymer.

5. Magnetic composite particles according to claim 1, wherein the bio-based polymer has a molecular weight of 2,000 to 1,000,000.

6. Magnetic composite particles according to claim 1, wherein the magnetic composite particles comprise an alkali earth metal in an amount of not more than 1.0% by weight.

7. Magnetic composite particles according to claim 1, wherein the magnetic fine particles are ferrite or an iron powder.

8. A magnetic carrier comprising the magnetic composite particles as defined in claim 1.

9. A developer comprising the magnetic carrier as defined in claim 8.

10. A magnetic carrier comprising the magnetic composite particles as defined in claim 1, and a coating layer formed on a surface of the magnetic composite particles of the magnetic carrier.

11. A developer comprising the magnetic composite particles as defined in claim 1.

12. A magnetic carrier comprising the magnetic composite particles as defined in claim 1, and a coating layer formed on a surface of the magnetic carrier.

* * * * *